US010410778B2

(12) United States Patent
Kondou et al.

(10) Patent No.: US 10,410,778 B2
(45) Date of Patent: Sep. 10, 2019

(54) MAGNETIC CIRCUIT COMPONENT

(71) Applicant: DENSO CORPORATION, Kariya, Aichi-pref. (JP)

(72) Inventors: Naoya Kondou, Kariya (JP); Akira Sakamoto, Kariya (JP); Kazuhiro Umetani, Kariya (JP)

(73) Assignee: DENSO CORPORATION, Kariya (JP)

( * ) Notice: Subject to any disclaimer, the term of this patent is extended or adjusted under 35 U.S.C. 154(b) by 174 days.

(21) Appl. No.: 15/311,882

(22) PCT Filed: Jun. 30, 2015

(86) PCT No.: PCT/JP2015/003269

§ 371 (c)(1),
(2) Date: Nov. 17, 2016

(87) PCT Pub. No.: WO2016/006198

PCT Pub. Date: Jan. 14, 2016

(65) Prior Publication Data

US 2017/0278606 A1 Sep. 28, 2017

(30) Foreign Application Priority Data

Jul. 8, 2014 (JP) ..... 2014-140436

(51) Int. Cl.

| | |
|---|---|
| ***H01F 5/00*** | (2006.01) |
| ***H01F 1/12*** | (2006.01) |
| ***H01F 3/14*** | (2006.01) |
| ***H01F 5/04*** | (2006.01) |
| ***H01F 5/06*** | (2006.01) |
| ***H01F 3/10*** | (2006.01) |

(Continued)

(52) U.S. Cl.

CPC ..... *H01F 1/12* (2013.01); *H01F 3/10* (2013.01); *H01F 3/14* (2013.01); *H01F 5/003* (2013.01);

(Continued)

(58) Field of Classification Search

USPC ..... 336/200, 232, 83

See application file for complete search history.

(56) References Cited

U.S. PATENT DOCUMENTS 4,013,911 A * 3/1977 Fujiwara ..... H01F 29/10 310/168
5,345,209 A * 9/1994 Saitoh ..... H01F 17/043 336/134

(Continued)

FOREIGN PATENT DOCUMENTS

JP 58-057719 A 4/1983
JP 360224208 A * 4/1984

(Continued)

OTHER PUBLICATIONS

Soft Magnetic Materials; Google NPL.*
Google NPL, Soft magnetic Material (Year: 2018).*

*Primary Examiner* — Elvin G Enad
*Assistant Examiner* — Kazi S Hossain
(74) *Attorney, Agent, or Firm* — Posz Law Group, PLC

(57) ABSTRACT

A magnetic circuit component includes a magnetic core and a coil formed by winding a conductor around the magnetic core. The magnetic circuit component includes a magnetic material section that is formed from a soft magnetic material, and that covers a part of a surface of the coil or the entire surface of the coil and is disposed away from the magnetic core.

14 Claims, 14 Drawing Sheets

(51) Int. Cl.
*H01F 27/32* (2006.01)
*H01F 27/34* (2006.01)
*H01F 27/36* (2006.01)

(52) U.S. Cl.
CPC ..... *H01F 5/04* (2013.01); *H01F 5/06* (2013.01); *H01F 27/325* (2013.01); *H01F 27/346* (2013.01); *H01F 27/365* (2013.01); *H01F 2003/106* (2013.01); *H01F 2027/348* (2013.01)

(56) References Cited

U.S. PATENT DOCUMENTS 6,950,291 B1 * 9/2005 Andres ..... H01F 27/362 361/118
2006/0145803 A1 * 7/2006 Chung ..... F16D 27/112 336/192
2008/0309443 A1 * 12/2008 Furuya ..... H01F 17/045 336/83
2010/0033284 A1 * 2/2010 Yamakami ..... H01F 27/324 336/192
2011/0001595 A1 * 1/2011 Kudo ..... H01F 17/045 336/192
2013/0126264 A1 * 5/2013 Takenoshita ..... C04B 35/2658 181/175
2014/0292467 A1 * 10/2014 Tai ..... H01F 27/24 336/192

FOREIGN PATENT DOCUMENTS

JP 60-224208 A 11/1985
JP 2000-012325 A 1/2000
WO 2006/046358 A1 5/2006

* cited by examiner

MAGNETIC CIRCUIT COMPONENT

CROSS REFERENCE TO RELATED APPLICATION APPLICATIONS

This application is a U.S. national stage of International Application No. PCT/JP2015/003269 filed on Jun. 30, 2015 and is based on Japanese Patent Application No. 2014-140436 filed on Jul. 8, 2014, the disclosure of which is incorporated herein by reference.

TECHNICAL FIELD

This disclosure relates to a magnetic circuit component.

BACKGROUND ART

In recent years, the downsizing of a magnetic circuit component such as a reactor or a transformer used in a power supply circuit is urged strongly with an increasing demand for the downsizing of a switching power supply. In a switching power supply, as a method of materializing downsizing, higher frequency is attempted in some cases. Eddy-current loss caused by skin effect, proximity effect, or leakage flux in a copper wire or a coil increases with the increase of frequency and thus a problem here is that the alternating-current resistance of a coil increases. When an alternating-current resistance increases, loss generated in a coil increases and hence a significant deterioration in the efficiency of a switching power supply is concerned.

On this occasion, with regard to the loss, when a higher frequency is taken into consideration as a premise, an alternating-current resistance increases in proportion to the one-half power of a frequency in the case of the skin effect. In comparison with the skin effect in contrast, an eddy-current loss increases in proportion to the square of a frequency in the case of an alternating-current resistance caused by a leakage flux. Consequently, a challenge on the occasion of higher frequency is to restrain an alternating-current resistance caused by leakage flux from increasing. In addition, in a reactor or a transformer for a switching power supply, a magnetic core (core) is arranged next to a coil in many cases and hence loss caused by a leakage flux from a magnetic core is likely to be generated.

As a measure of challenge for reducing eddy-current loss generated by a leakage flux, a technology of plating the outer circumference of a copper wire forming a coil with a soft magnetic material such as iron (Fe) or nickel (Ni) is proposed for example. As a result, since a magnetic field generated in another conductive material can pass not through the own conductive material but through a soft magnetic material, the magnetic field acting in the interior of the conductive material can be reduced and an eddy-current loss generated by the magnetic field can be restrained.

PRIOR ART DOCUMENT

Patent Document

Patent Document 1: WO 2006/046358 A1

By the above configuration, eddy current can be restrained effectively from being generated under the assumption that a single conductor exists in an AC magnetic field. In the use in a reactor or a transformer however, a problem not avoidable by the configuration is newly generated and the effect of restraining an eddy current may not be exhibited effectively sometimes in the case of the shape of a tightly wound coil or in the case of the situation of installing a core in the vicinity of a coil.

The reason is presumably that, when a high frequency electric current conducts in a coil formed by winding a wire such as a copper wire coated with a soft magnetic material by plating, a magnetic field created by adjacent winding wires influences the own copper wire and a phenomenon called proximity effect of disproportioning the distribution of the eddy-current loss stated earlier occurs significantly.

As a problem worsening the situation, a problem of leakage flux from a core exists. When a winding wire of a coil is plated with a magnetic material, the leakage flux from a core passes preferably through the plating. In a downsized reactor or inductor particularly, a core is generally arranged next to a coil surface and hence the magnetic flux leaking from the core passes more through the coil surface.

By the problems of increasing the influence of proximity effect generated between winding wires and the leakage flux from a core when a winding wire is plated with a magnetic material in a coil in a reactor or an inductor, an accompanying problem is that magnetic saturation is likely to occur in view of the fact that a magnetic flux of a large density passes through the plating of the coil surface and the plating comprises a thin film of the magnetic material. Since an eddy current is proportional to the magnitude of a magnetic flux density and inversely proportional to a magnetic permeability, an eddy current also increases when a magnetic flux density increases. Consequently, when magnetic saturation occurs at the plating section of a winding wire, a substantial magnetic permeability lowers and hence an increasingly large eddy current is generated undesirably.

SUMMARY OF INVENTION

The present disclosure addresses the above issues. Thus, it is an objective of the present disclosure to provide a magnetic circuit component capable of reducing the alternating-current resistance of a coil efficiently in the state of installing a winding wire as a reactor or an inductor.

A magnetic circuit component in an aspect of the present disclosure includes a magnetic core, a coil that is formed by winding a conductor around the magnetic core, and a magnetic material section that is formed from a soft magnetic material, and that covers a part of a surface of the coil or the entire surface of the coil and is disposed away from the magnetic core.

By adopting the above configuration, a magnetic material section is formed over a coil surface where a magnetic flux concentrates in the state of a coil formed by winding a conductor and hence it is possible to attempt to: reduce the density of the magnetic flux over the coil surface; and reduce an eddy-current loss. As a result further, it is possible to reduce the quantity of a magnetic material not contributing to the reduction of a magnetic flux density in comparison with the case of constituting the conductor of a coil with a magnetic plated wire, in other words, it is possible to obtain the effect of reducing a magnetic flux density more effectively when the quantity of a magnetic material is identical by arranging a not-functioning magnetic material over the surface of a coil. This is synonymous with the increase of a sectional area with which a magnetic flux interlinks and, when an electricity is applied to a conductive wire so as to generate an identical magnetic flux, it is possible to reduce the magnetic flux density in the interior of the magnetic material section comprising a magnetic material to the extent of the increase of the sectional area. As a result, the same eddy-current loss reduction effect as magnetic plating is obtained and at the same time magnetic saturation that emerges as the problem caused by a magnetic plated wire can be restrained without increasing the quantity of a magnetic material at an extra cost.

BRIEF DESCRIPTION OF DRAWINGS

The above and other objects, features and advantages of the present disclosure will become more apparent from the following detailed description made with reference to the accompanying drawings. In the drawings.

EMBODIMENTS FOR CARRYING OUT INVENTION

First Embodiment

Figure 1A:
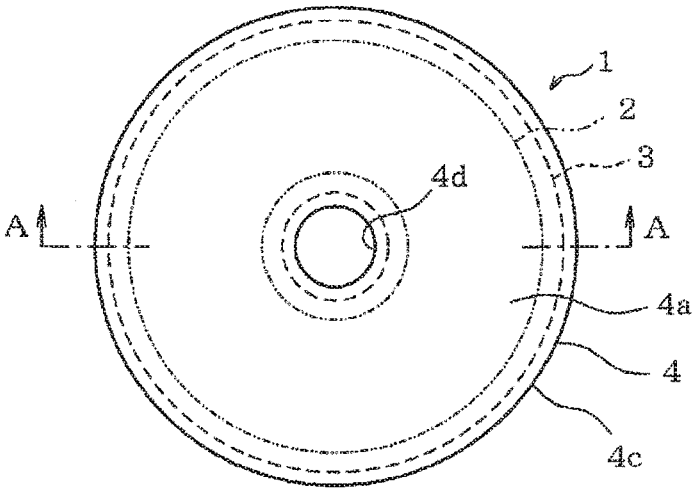
FIG. 1A is a top view of a coil.

A first embodiment is explained hereunder in reference to FIGS. 1A to 3B. FIGS. 1A to 1C illustrate a whole configuration and an outer appearance of a coil 1 incorporated in a reactor or a transformer. FIG. 1A is a plan view of the coil 1 viewed from the top side and FIG. 1B is a sectional view taken on line A-A in FIG. 1A. Then FIG. 1C is an external perspective view in a cut state.

The coil 1 is configured by winding a rectangular conductor 2 having a cross section of a flat rectangle and the surface of the conductor 2 as a winding wire is covered with an insulation film 3. The insulation film 3 has an identical thickness as a whole and has a thickness in the range of 10 to 100 μm for example. The coil 1 is formed in the state of winding the conductor 2 around an axis z and stacking the flat faces in the direction of the axis z. The conductor 2 in the coil 1 is in the state of being partitioned by the insulation film 3 between vertically adjacent two conductors 2. Magnetic materials 4*a* to 4*d* are attached to a top face, a bottom face, an outside face, and an inside face, those faces constituting the surface of the coil 1, as a magnetic material section 4 comprising a soft magnetic material and the whole surface of the coil 1 is in the state of being covered with the magnetic material section 4. The magnetic materials 4*a* to 4*d* have an identical thickness in the range of 0.1 to 3.0 mm as a whole for example.

The coil 1 of the above configuration is used as a transformer or a reactor that is a magnetic circuit component in the state of being attached to an iron core as a magnetic core (core) not illustrated in the figures. As the iron core, an E-type or an I-type is used for example. In the case of an E-type iron core, the iron core penetrates and is inserted into the part of the axis z in the winding center of the coil 1 and is installed also on the outer circumference side of the coil 1 in the manner of surrounding the coil 1. In the case of an I-type iron core, the iron core is installed in the state of penetrating at the part of the axis z in the winding center of the coil 1. Here, the coil 1 is attached to the iron core in the state of interposing an insulator or the like around the outer peripheral face so that the magnetic materials 4*a* to 4*d* arranged over the outer peripheral face may not directly touch the iron core.

The action of the above configuration is explained hereunder. The coil 1 of the above configuration: is not configured to form a magnetic material by plating or the like individually over the outer peripheral face of the conductor 2; and is equipped with the magnetic material section 4 comprising a soft magnetic material over the outer peripheral face of the coil 1. As a result, the magnetic material section used for the coil 1; is not formed between vertically overlapping conductors 2; and thus can be used as the magnetic material section 4 formed over the outer peripheral face to that extent.

In the present embodiment therefore, the same eddy-current loss reduction effect as a magnetic plated wire can be obtained and at the same time magnetic saturation that is a problem in a coil comprising a magnetic plated wire can be restrained without increasing the quantity of a magnetic material at an extra cost.

Effects obtained by adopting the configuration of the coil 1 according to the present embodiment are explained hereunder. In advance, action in a transformer or a reactor of a configuration of using a magnetic plated wire formed by plating a conductor with a magnetic material is explained firstly.

In general, a magnetic flux passing through the vicinity is generated around a conductor constituting a coil by an electric current conducting in a conductor of another coil or a leakage flux from a magnetic core. Further, an AC component is included in an electric current conducting in a coil and an AC component Bac is included also in a magnetic flux generated around the conductor of a coil. On the other hand, an AC magnetic flux cannot pass through the interior of a coil conductor and hence the AC magnetic flux is zero in the interior of the conductor.

In this context, a rectangular minute closed curve C thinly surrounding the surface of a conductor in a coil is examined in an AC magnetic field and the Ampere's rule is applied over the closed curve C. Then an eddy current lac generated in the zone surrounded by the closed curve C is obtained by the following expression (1). Here, dl is a linear element and l (el) is the length of a closed curve C. $\mu_s$ is a magnetic permeability at a conductor surface.

[Expression 1]

$$I_{ac} = \int_C H dl = \frac{B_{ac}}{\mu_s} l \tag{1}$$

It is obvious therefore that an eddy current of Bac/$\mu_s$ per unit length is generated at the surface of a conductor in a coil. Then it is obvious from the expression (1) that an eddy current lac reduces by forming a film of a magnetic material over a conductor surface and increasing a magnetic permeability $\mu_s$. For the reason, a loss caused by eddy current can be restrained from being generated by magnetic plating applied over the surface of a conductor.

In this way, under the assumption that a single conductor exists in an AC magnetic field, eddy current can be restrained effectively from being generated as stated above. In consideration of the shape of a tightly wound coil or the existence of a core in the vicinity of a coil as it is used for a reactor or a transformer however, a new problem arises and hence the effect of restraining eddy current may not effectively be exhibited undesirably. More specifically, when a high-frequency electric current is applied in a coil formed by winding a coated copper wire, a magnetic field created by adjacent copper wires influences the own copper wires and a phenomenon called proximity effect of disproportioning the distribution of the eddy-current loss stated earlier occurs significantly.

Figure 1B:
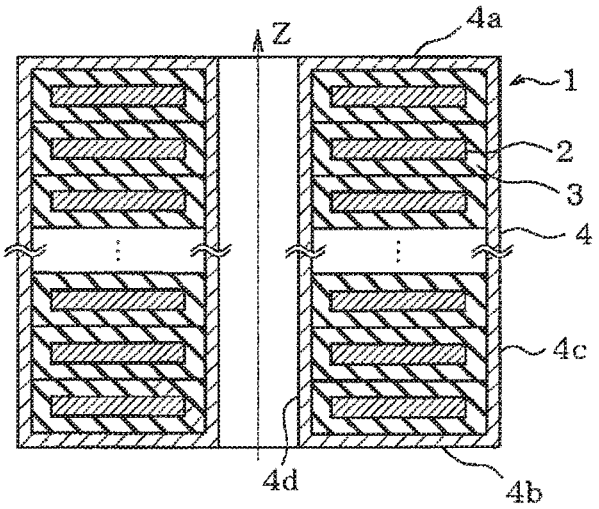
FIG. 1B is a longitudinal sectional view of the coil taken on line A-A in FIG. 1A.
Figure 1C:
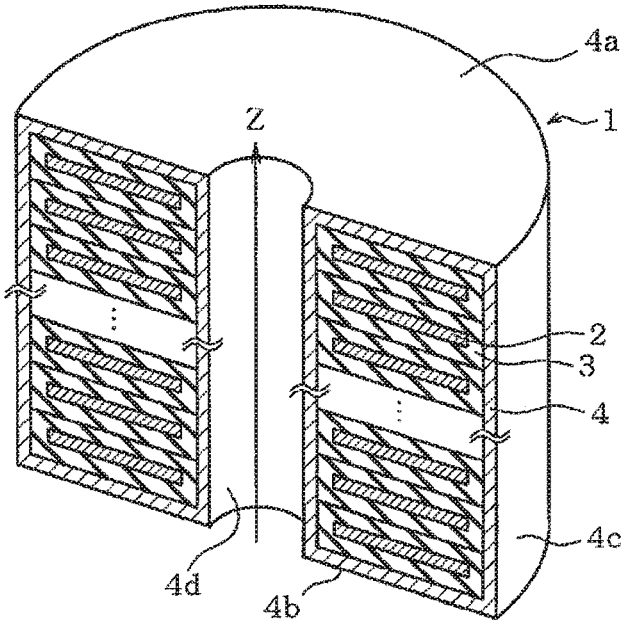
FIG. 1C is an external perspective view in the state of longitudinally cutting the coil according to a first embodiment.
Figure 2:
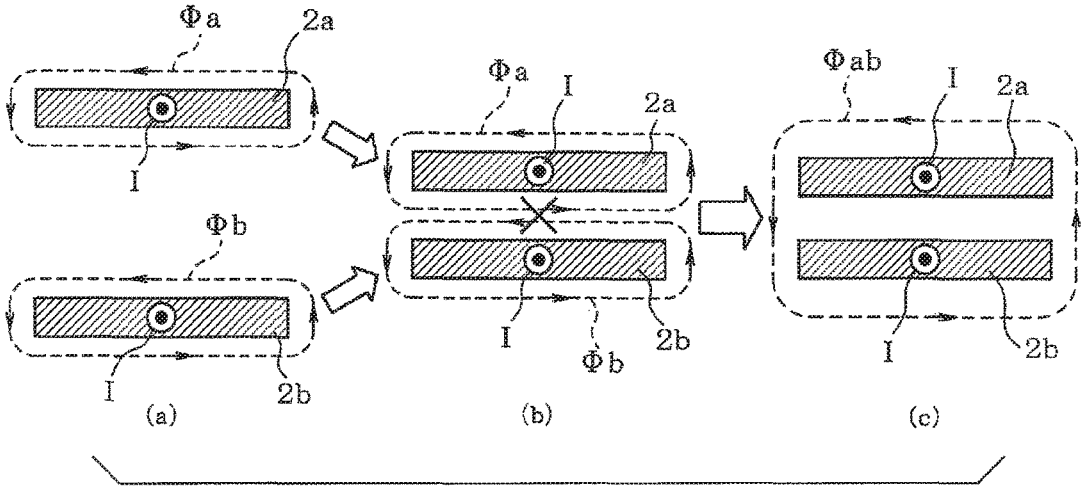
FIG. 2 is a view explaining proximity effect according to the first embodiment.
Figure 3A:
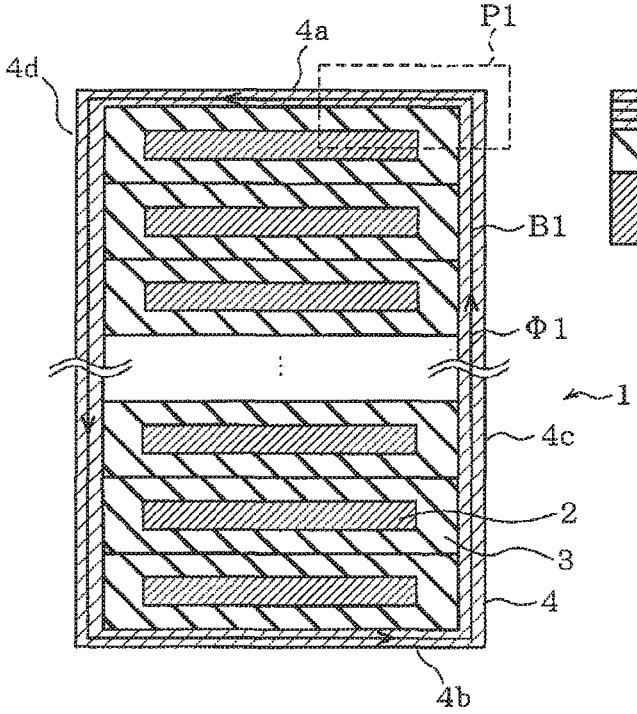
FIG. 3A is a view illustrating the state of a magnetic flux in a magnetic material section in a longitudinal cross section of a coil.
Figure 3B:
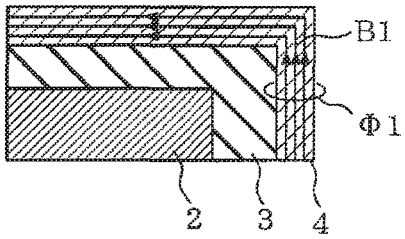
FIG. 3B is an enlarged view of the region P1 surrounded by the broken line in FIG. 3A according to the first embodiment.

The mechanism of proximity effect is illustrated in FIG. 2. In the arrangement of separating two copper wires 2*a* and 2*b* conducting electricity in an identical direction as illustrated in (a) of FIG. 2 for example, magnetic fields Φa and Φb are generated around the copper wires 2*a* and 2*b* respectively. In contrast, when the copper wires 2*a* and 2*b* are arranged at adjacent locations as illustrated in (b) of FIG. 2, the generated magnetic fields Φa and Φb have the vectors directed in the directions opposite to the magnetic fields generated from the own copper wires 2*b* and 2*a* and hence negate each other at the respective vicinal planes of the copper wire 2*a* adjacent to the copper wire 2*b* and the copper wire 2*b* adjacent to the copper wire 2*a*. Consequently, as illustrated in (c) of FIG. 2 in effect, since the AC magnetic fields negate each other and weaken in the region between the copper wires 2*a* and 2*b*, the generation of eddy current reduces and the effect reduces even when magnetic plating is applied over the surfaces of the copper wires. In contrast, at the planes on the outer sides of the copper wires 2*a* and 2*b*, the magnetic fields Φa and Φb strengthen each other and come to be a large magnetic field Φab and hence a large eddy current is likely to be generated. Such a phenomenon appears also in the coil 1 formed by multiplex winding a copper wire as illustrated in FIG. 1A to 1C and the magnetic field in the vicinity of the surface of the coil 1 is higher than a magnetic field at a part between the conductors 2 in the coil 1.

Meanwhile, as a problem further worsening the situation, there is the problem of a leakage flux from a core (iron core) around which the coil 1 is wound. When the conductor 2 of the coil 1 is plated with a magnetic material, a leakage flux from a core passes through the plating. In a downsized reactor or inductor in particular, a core is generally arranged adjacently to the surface of a coil 1 and hence particularly the magnetic flux leaking from the core passes more through the surface of the coil 1.

In this way, there is the problem of increasing the influence of proximity effect generated between conductors 2 and a leakage flux from a core when a conductor 2 is plated with a magnetic material in a coil 1 of a reactor or an inductor and resultantly there is the problem of increasing a magnetic flux density at the plating over the coil surface and being likely to generate magnetic saturation in consideration of the fact that the plating comprises a thin film of a magnetic material. Originally, a large magnetic flux density causes a large eddy current to be generated from the expression (1). Moreover, when a plating is subjected to magnetic saturation, a magnetic permeability lowers and hence an increasingly large eddy current is generated undesirably as represented by the expression (1).

In this regard, the coil 1 according to the present embodiment: eliminates a magnetic material at the part other than the surface of the coil which has not been functioning in the coil comprising a magnetic plated wire as stated above; and has a magnetic material section 4 configured so as to arrange magnetic materials 4*a* to 4*d* much to that extent over the surface of the coil 1 where a magnetic flux concentrates. This is synonymous with the increase of a sectional area S with which a magnetic flux interlinks. Consequently, to a magnetic flux Φ1 generated by the conductor 2, a magnetic flux density B1 in the interior of the magnetic material section 4 comprising a soft magnetic material is represented by B1=Φ1/S and hence reduces to the extent of the increase of the sectional area S.

The present inventors have verified this point by simulation. When a magnetic flux density at a corner of a coil 1 according to the present embodiment is compared with that in the case of a coil formed by a magnetic plated wire, it has been found that, under the conditions of equalizing the magnetic permeability of a soft magnetic material, the quantity of the soft magnetic material, the shape of a copper wire, and the number of turns, a magnetic flux density B1 can be reduced by arranging a thick magnetic material section 4 at a location where a strong magnetic field is generated in the coil 1 according to the present embodiment.

From the above, by using a coil 1 according to the present embodiment, the same eddy-current loss reduction effect as magnetic plating is obtained and at the same time magnetic saturation that emerges as the problem caused by a magnetic plated wire in the coil can be restrained without increasing the quantity of a magnetic material at an extra cost.

According to the present embodiment, since the configuration of coating a conductor 2 constituting a coil 1 with an insulation film 3 and arranging a magnetic material section 4 over the surface of the coil 1 is adopted, a magnetic flux density can be reduced at a corner of the coil 1 where a magnetic flux is likely to concentrate and the effect of restraining eddy current can be increased even when an AC electric current of a high frequency conducts. Further, since the conductor 2 is not covered with a magnetic material, a thick magnetic material section 4 can be formed over the surface without increasing the whole volume of the coil 1 and the quantity of the used magnetic material by: not using a magnetic material at a part less effectively contributing to the reduction of a magnetic flux density; and arranging the magnetic material over the surface preferentially.

Second Embodiment

FIGS. 4A to 5C illustrate a second embodiment. In the embodiment, a coil 11 is configured to have a magnetic material section 14 (14*a* and 14*b*): split so as to expose parts of an insulation film 13 over the surface of a wound conductor 12; and arranged in place of the magnetic material section 4 according to the first embodiment.

Figure 4A:
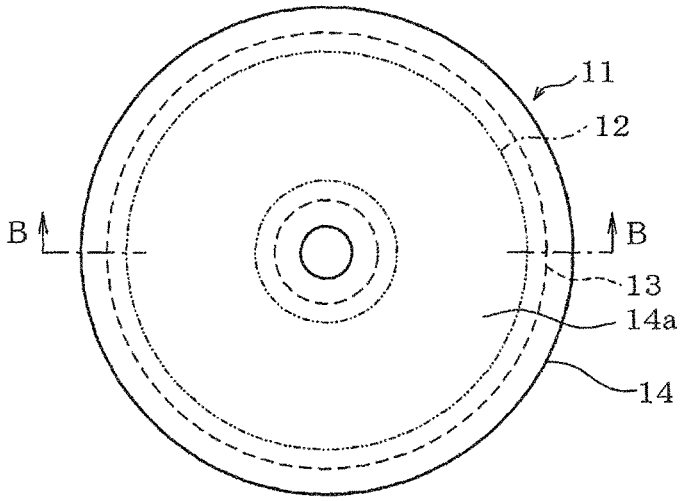
FIG. 4A is a top view of a coil.
Figure 4B:
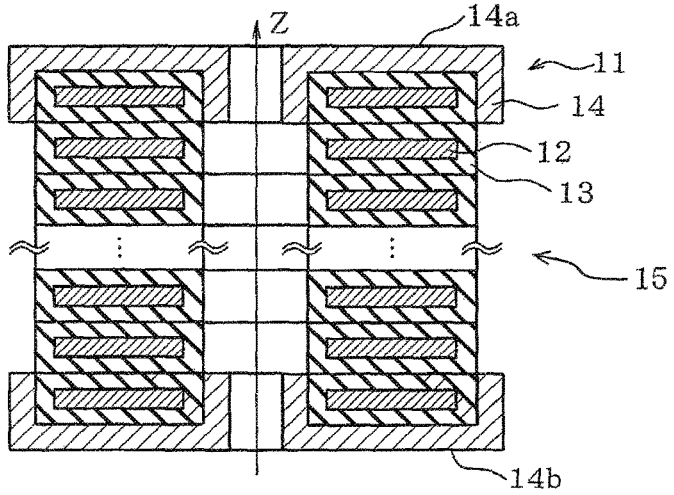
FIG. 4B is a longitudinal sectional view of the coil taken on line B-B in FIG. 4A.
Figure 4C:
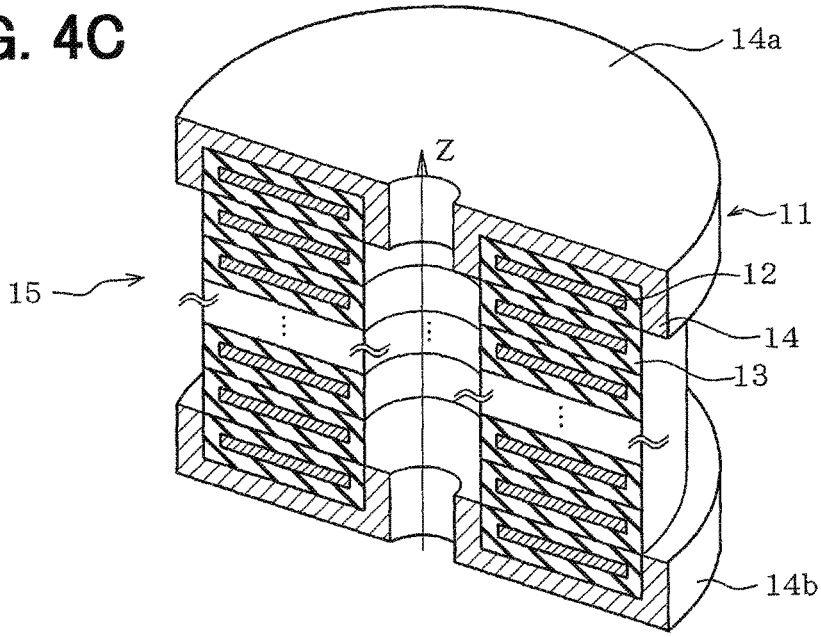
FIG. 4C is an external perspective view illustrating a longitudinal sectional side face of the coil according to a second embodiment.

As illustrated in FIGS. 4A to 4C, a coil 11 is formed by winding a conductor 12 covered with an insulation film 13 similarly to the first embodiment. A cap-shaped magnetic material section 14*a* covering a top face and parts of an outside face and an inside face is installed and a cap-shaped magnetic material section 14*b* covering a bottom face and parts of an outside face and an inside face is installed, those faces constituting the surface of the coil 11. More specifically, the magnetic material sections 14*a* and 14*b* are installed at the parts corresponding to the start and the end of the winding of the conductor 12 in the coil 11 respectively. The magnetic material sections 14*a* and 14*b* are formed by attaching tabular magnetic materials comprising a soft magnetic material to the coil 11 respectively. The thicknesses of the magnetic material sections 14*a* and 14*b* are in the range of 0.1 to 3.0 mm for example.

The coil 11 of the above configuration is used as a reactor or a transformer in the state of being attached to an iron core not illustrated in the figures. As the iron core, an E-type or an I-type is used for example. In the case of an E-type iron core, the iron core penetrates and is inserted into the part of the axis z in the winding center of the coil 11 and is installed also on the outer circumference side of the coil 11 in the manner of surrounding the coil 11. In the case of an I-type iron core, the iron core is installed in the state of penetrating at the part of the axis z in the winding center of the coil 11. Here, the coil 11 is attached to the iron core in the state of interposing an insulator or the like around the outer peripheral face so that the magnetic material sections 14*a* and 14*b* arranged over the outer peripheral face may not directly touch the iron core.

Figure 5A:
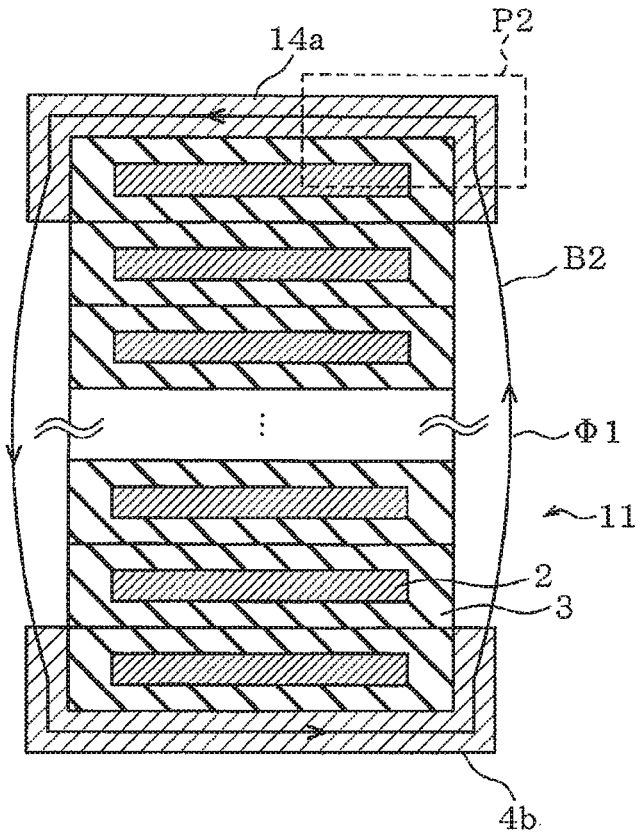
FIG. 5A is a view illustrating the state of a magnetic flux in a magnetic material section in a longitudinal cross section of a coil.
Figure 5B:
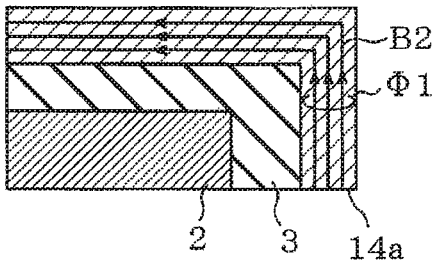
FIG. 5B is an enlarged view of the region P2 surrounded by the broken line in FIG. 5A.

As a result of the above configuration, a magnetic flux is generated in the magnetic material sections 14*a* and 14*b* attached to the coil 11 when electric current is applied to the coil 11. In this instance, the magnetic flux Φ1 distributes as illustrated in FIG. 5A or FIG. 5B that is illustrated in the manner of expanding the part of the region P2 in FIG. 5A. The magnetic resistance is low in the magnetic material sections 14*a* and 14*b* and hence is in the state of distributing nearly equally, the magnetic flux density 62 can also be kept low, and eddy current can be restrained from being generated. At the outside face part and inside face part of the coil 11 where the magnetic material sections 14*a* and 14*b* are not arranged, the magnetic flux Φ1 takes a curved magnetic flux distribution in the manner of separating from the side faces of the coil 11.

The history of adopting such a configuration is explained hereunder. Firstly, as stated above, when a cross section of the coil 11 is viewed, an AC magnetic flux density (and magnetic field) reduces significantly by proximity effect at the part between the conductors 12. As a result, a leakage flux (alternating-current) around the coil 11 is generated in the manner of going around the surface of the coil 11. In this instance, according to the magnetics, a generally arising problem is that, when a corner exists at a coil surface, an AC magnetic flux density increases significantly at the part.

Figure 5C:
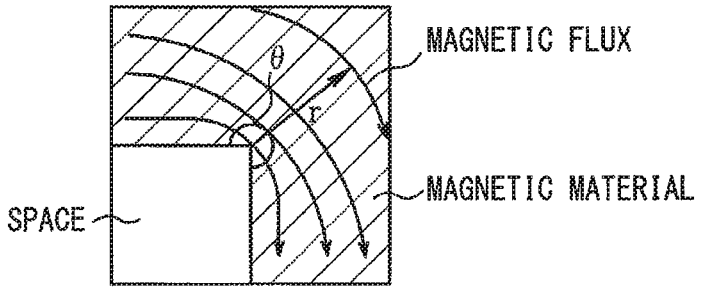
FIG. 5C is a view explaining the distribution state of a magnetic flux in the magnetic material according to the second embodiment.

It is assumed that a corner is formed in a coil cross section as illustrated in FIG. 4B for example. In this instance, in consideration of an AC magnetic field passing through only the surface region of the coil 11 the surface of the coil 11 forms the boundary of a site where the AC magnetic field is generated. With regard to the distribution of a magnetic field when the boundary has a corner, the following solution is known from the magnetics. More specifically, as illustrated in FIG. 5C, on the assumption that a magnetic permeability is not changed in a region close to a corner of a coil surface, in a site sufficiently close to an apex angle θ, a magnetic flux density distribution follows the distribution represented by the following expression (2). Here, a length r is a distance from the apex of a corner, θ is the apex angle of a corner, and B2 is a magnetic flux density.

[Expression 2]

$$B \propto r^{\pi/\theta - 1} \tag{2}$$

According to the expression (2), like an ordinary corner in a cross section of the coil 11, when θ is larger than π, B diverges at the apex of the corner. Consequently, a magnetic flux density B2 tends to increase particularly at the corner of the surface of the coil 11. Then by installing magnetic material sections 14*a* and 14*b* formed by arranging a magnetic material so as to be thicker preferentially at a corner in particular, it is possible to restrain the magnetic saturation of a magnetic material film and restrain eddy-current loss effectively by the addition of a small quantity of the magnetic material. In other words, an alternating-current resistance can be reduced effectively by the addition of a small quantity of the magnetic material.

Further, as indicated in the first embodiment, to install a magnetic material so as to cover the surface of the coil 11 is effective for reducing eddy-current loss induced by a magnetic flux leaking from an exterior. In this embodiment, the aforementioned configuration is adopted in order to further improve the effect. More specifically, the magnetic material sections 14*a* and 14*b* are configured in the manner of not covering the whole coil 11 but covering the coil 11 partially.

The reason is as follows. Let's assume the state of covering the whole cross section of a coil 11 with a magnetic material section 14 similarly to the first embodiment. In this instance, a closed curve C around a cross section of the coil 11 is assumed and an AC electric current I is regarded as flowing in the coil 11. In the state, by applying the Ampere's rule to the closed curve C, the following expression (3) is obtained. Here, l (el) is the length of a closed curve C, Hav is an average magnetic field, Bav is an average magnetic flux density, and $\mu_s$ is the magnetic permeability of the magnetic material section 14. A value NI obtained by multiplying the number of turns N by an electric current I is determined by the usage (by the specification) of an inductor or a transformer and hence the left side is given. Consequently, when the magnetic permeability of the magnetic material section 14 is high, it sometimes happens that a high magnetic flux density is generated, the magnetic material section 14 is subjected to magnetic saturation undesirably, and an eddy-current loss effect is not obtained sufficiently.

[Expression 3]

$$NI = \int_C H dl = H_{av} l = \frac{B_{av}}{\mu_s} l \tag{3}$$

This reflects that, by assuming the configuration of covering the whole circumference of the coil 11 with the magnetic material section 14, the magnetic resistance of the magnetic route of the closed curve C reduces and hence a very large magnetic flux density is induced by an AC electric current in the coil. Then by adopting the configuration of the magnetic material sections 14*a* and 14*b*, a state of forming gaps at parts of the side face section of the coil 11 is obtained, the magnetic resistance of the closed curve C is increased sufficiently, and hence an excessively large magnetic flux density can hardly be induced in a magnetic film. As a result, since the magnetic flux density in the magnetic material sections 14*a* and 14*b* lowers, the magnetic saturation in the magnetic film is mitigated and eddy-current loss at the part covered with the magnetic film can be restrained from being generated preferably. As a result, the alternating-current resistance of the coil 11 can be reduced.

In this way, by not covering the whole circumference of a coil 11 with a magnetic material, eddy-current loss can be reduced at a part covered with the magnetic material. In contrast, at a part of forming a gap where a magnetic material section is not formed, the effect of reducing eddy-current loss cannot be expected. Then in the present embodiment, the configuration of arranging magnetic material sections 14*a* and 14*b* at corners of a coil 11 where eddy current is likely to be generated and forming gaps at parts where eddy current is hardly generated is adopted.

As stated earlier, in the vicinity of a corner on the outer or inner circumference of a coil 11, a magnetic flux density is likely to increase and hence it is undesirable to form a gap. Inversely, at a part distant from a corner of a coil 11, a magnetic flux density is small and hence a gap is likely to be allowed to be formed. It is obviously desirable therefore to form gaps where magnetic material sections 14*a* and 14*b* are not arranged so as to split a magnetic material section 14 in the z-axis direction by a split part 15 over the outer surface in a cross section of a coil 11.

Since a coil 11 is configured in consideration of the above circumstances and magnetic material sections 14*a* and 14*b* covering the corners on the outer and inner circumferences of the coil 11 where a magnetic flux density rises are arranged so as to have larger cross-sectional areas at the corners in the parts through which a magnetic flux generated when an electric current is applied to the coil 11 passes, the increase and saturation of a magnetic flux density can be restrained and the generation of eddy current can be reduced accordingly.

Further, since the magnetic material sections 14*a* and 14*b* are formed separately at the upper and lower sections of a coil 11 and gaps where a magnetic material is not arranged are formed at the outer and inner circumference surface parts in the z-axial direction, a magnetic resistance can be increased sufficiently, the magnetic flux densities at the magnetic material sections 14*a* and 14*b* lower accordingly, the magnetic saturation of the magnetic material sections 14*a* and 14*b* is mitigated, and eddy-current loss at the part covered with the magnetic material can be restrained appropriately from being generated. As a result, the alternating-current resistance of the coil 11 can be reduced.

Third Embodiment

FIGS. 6A to 7B illustrate a third embodiment. In the embodiment, a coil 21 is configured to have a magnetic material section 24 (24*a* to 24*d*) split into four sections so as to expose parts of the surface of an insulation film 23 over a wound conductor 22 and arranged.

Figure 6A:
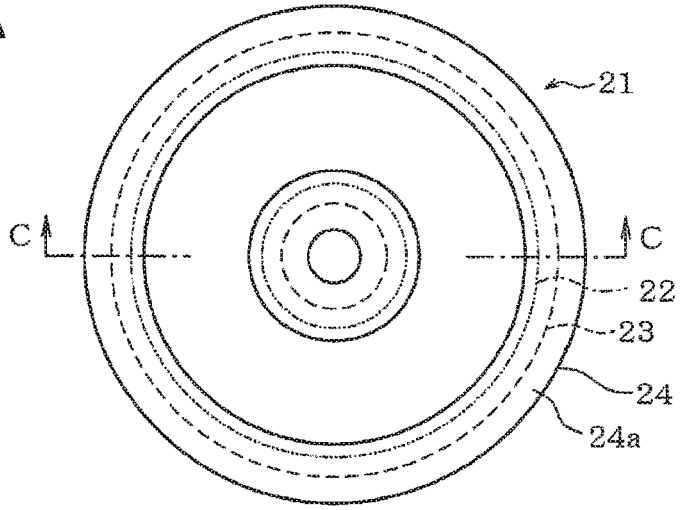
FIG. 6A is a top view of a coil.
Figure 6B:
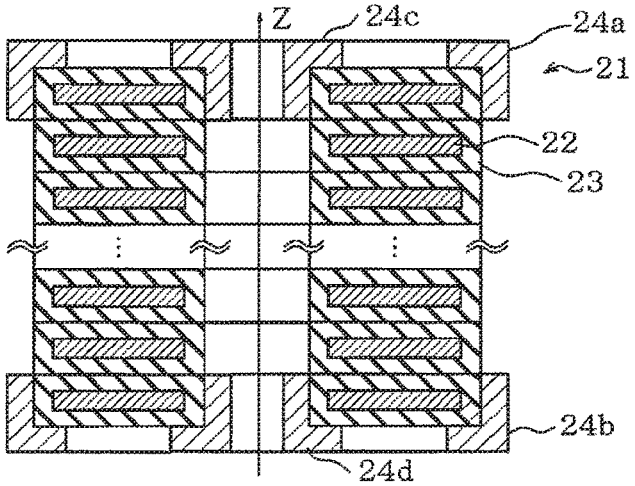
FIG. 6B is a longitudinal sectional view of the coil taken on line C-C in FIG. 6A.
Figure 6C:
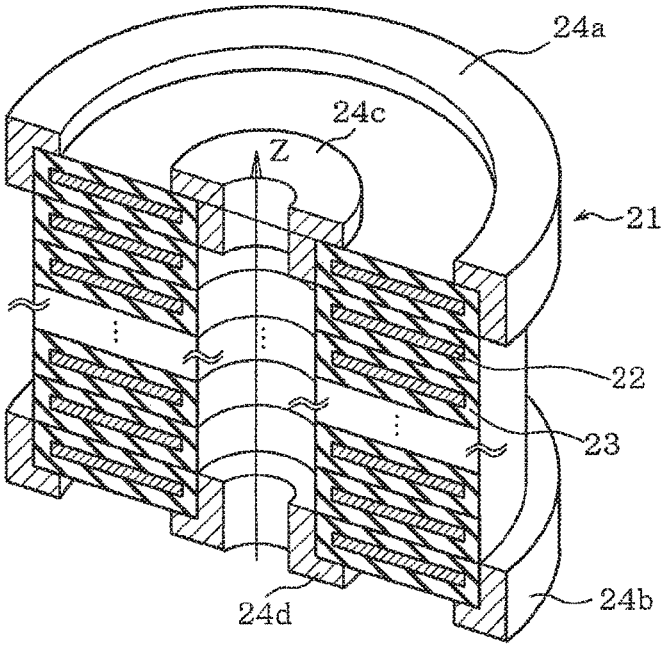
FIG. 6C is an external perspective view illustrating a longitudinal sectional side face of the coil according to a third embodiment.

As illustrated in FIGS. 6A to 6C, a coil 21 is formed by winding a conductor 22 covered with an insulation film 23 similarly to the first embodiment. A magnetic material section 24*a* covering upper outside-and-top faces, a magnetic material section 24*b* covering lower outside-and-bottom faces, a magnetic material section 24*c* covering upper inside-and-top faces, and a magnetic material section 24*d* covering lower inside-and-bottom faces, those faces constituting the surface of the coil 21, are installed respectively. The magnetic material sections 24*a* to 24*d* are formed by attaching tabular magnetic materials comprising a soft magnetic material to the coil 21 respectively. The thicknesses of the magnetic material sections 24*a* to 24*d* are in the range of 0.1 to 3.0 mm for example.

The coil 21 of the above configuration is used as a reactor or a transformer in the state of being attached to an iron core not illustrated in the figures. As the iron core, an E-type or an I-type is used for example. In the case of an E-type iron core, the iron core penetrates and is inserted into the part of the axis z in the winding center of the coil 21 and is installed also on the outer circumference side of the coil 21 in the manner of surrounding the coil 21. In the case of an I-type iron core, the iron core is installed in the state of penetrating at the part of the axis z in the winding center of the coil 21. Here, the coil 21 is attached to the iron core in the state of interposing an insulator or the like around the outer peripheral face so that the magnetic materials 24*a* to 24*d* arranged over the outer peripheral face may not directly touch the iron core.

Figure 7A:
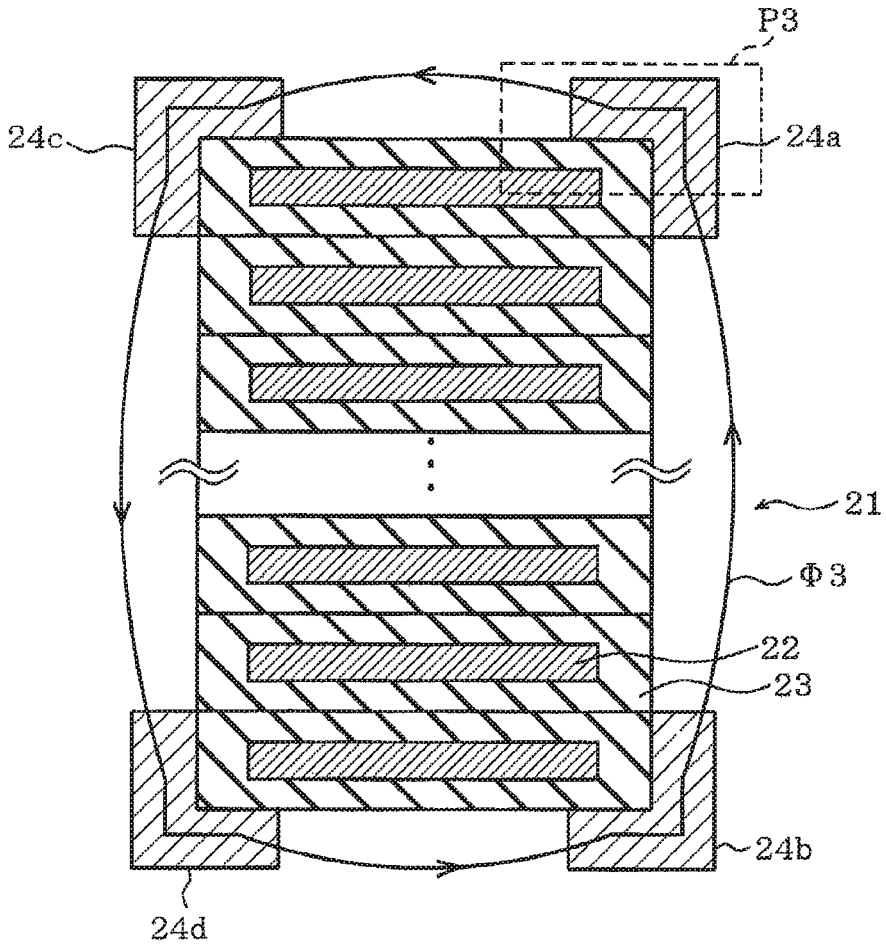
FIG. 7A is a view illustrating the state of a magnetic flux in a magnetic material section in a longitudinal cross section of a coil.
Figure 7B:
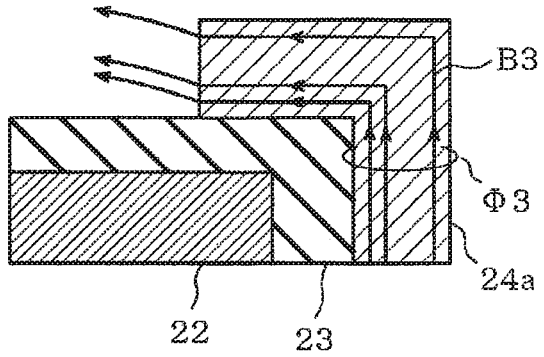
FIG. 7B is an enlarged view of the region P3 surrounded by the broken line in FIG. 7A according to the third embodiment.

As a result of the above configuration, a magnetic flux is generated in the magnetic material sections 24*a* to 24*d* attached to the coil 21 when electric current is applied to the coil 21. In this instance, the magnetic flux Φ3 distributes as illustrated in FIG. 7A or FIG. 7B that is illustrated in the manner of expanding the part of the region P3 in FIG. 7A. The magnetic resistance is low in the magnetic material sections 24*a* to 24*d* and hence is in the state of distributing nearly equally, the magnetic flux density B3 can also be kept low, and eddy current can be restrained from being generated. At an outside face part, an inside face part, and top and bottom face parts in the center region of the coil 21 where the magnetic material sections 24*a* to 24*d* are not arranged, the magnetic flux Φ3 takes a curved magnetic flux distribution in the manner of separating from the side faces of the coil 21.

Since a coil 21 is configured in consideration of the above circumstances and magnetic material sections 24*a* to 24*d* covering the four corners on the outer and inner circumferences of the coil 21 where a magnetic flux density rises are arranged so as to have large cross-sectional areas at the corners in the parts through which a magnetic flux generated when an electric current is applied to the coil 21 passes, the increase and saturation of a magnetic flux density can be restrained and the generation of eddy current can further be reduced accordingly.

Further, since the magnetic material sections 24*a* to 24*d* are formed separately at the four corners of a coil 21 and gaps where a magnetic material is not arranged are formed at the surface sections of the outer and inner circumferences and the surface sections of the top and bottom in the z-axial direction, a magnetic resistance can be increased sufficiently, the magnetic flux densities at the magnetic material sections 24*a* to 24*d* further lower accordingly, the magnetic saturation of the magnetic material sections 24*a* to 24*d* is further mitigated, and eddy-current loss at the part covered with the magnetic material can be restrained appropriately from being generated. As a result, the alternating-current resistance of the coil 21 can be reduced.

Fourth Embodiment

Figure 8A:
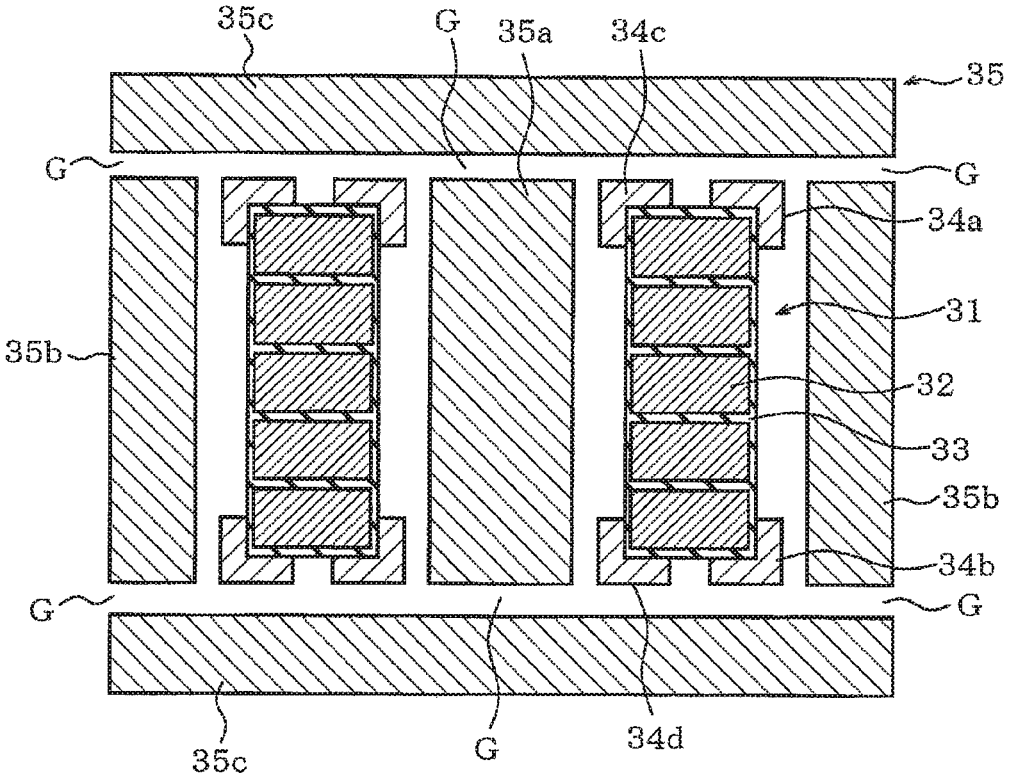
FIG. 8A is a longitudinal sectional view of a coil.
Figure 8B:
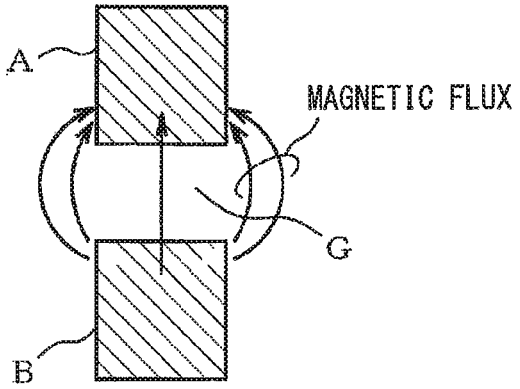
FIG. 8B is a view explaining a magnetic flux distribution according to a fourth embodiment.

FIGS. 8A and 8B illustrate a fourth embodiment. The present embodiment is configured to attach a coil 31 configured like the coil 21 illustrated in the third embodiment to an iron core 35.

In the embodiment, as illustrated in FIG. 8A, a coil 31 is configured to have a magnetic material section 34 (34*a* to 34*d*) split into four sections so as to expose parts of the surface of an insulation film 33 over a wound conductor 32 and arranged. The coil 31 is attached to an iron core 35 having gaps G. In the iron core 35, a leg section 35*a* passing through the center of the coil 31 and two leg sections 35*b* located outside the coil 31 are installed apart from yokes 35*e* arranged at the top and bottom with the gaps G interposed. In the iron core 35, as illustrated in FIG. 8B for example, a magnetic resistance increases at a gap G formed between iron cores A and B, a magnetic flux spreads outside, and a leakage flux is generated. Magnetic material sections 34*a* to 34*d* attached to the coil 31 are arranged in the manner of corresponding to the gaps G of the iron core 35.

In the coil 31 over which the iron core 35 of such a configuration is installed, the magnetic flux in the iron core 35 leaks at the gaps G and comes to be a component acting on the coil 31. The magnetic flux leaking at the gaps G however flows just in the magnetic material sections 34*a* to 34*d* of the coil 31 and the direct action to the coil 31 can be restrained. As a result, eddy-current loss can be restrained from increasing.

Fifth Embodiment

Figure 9:
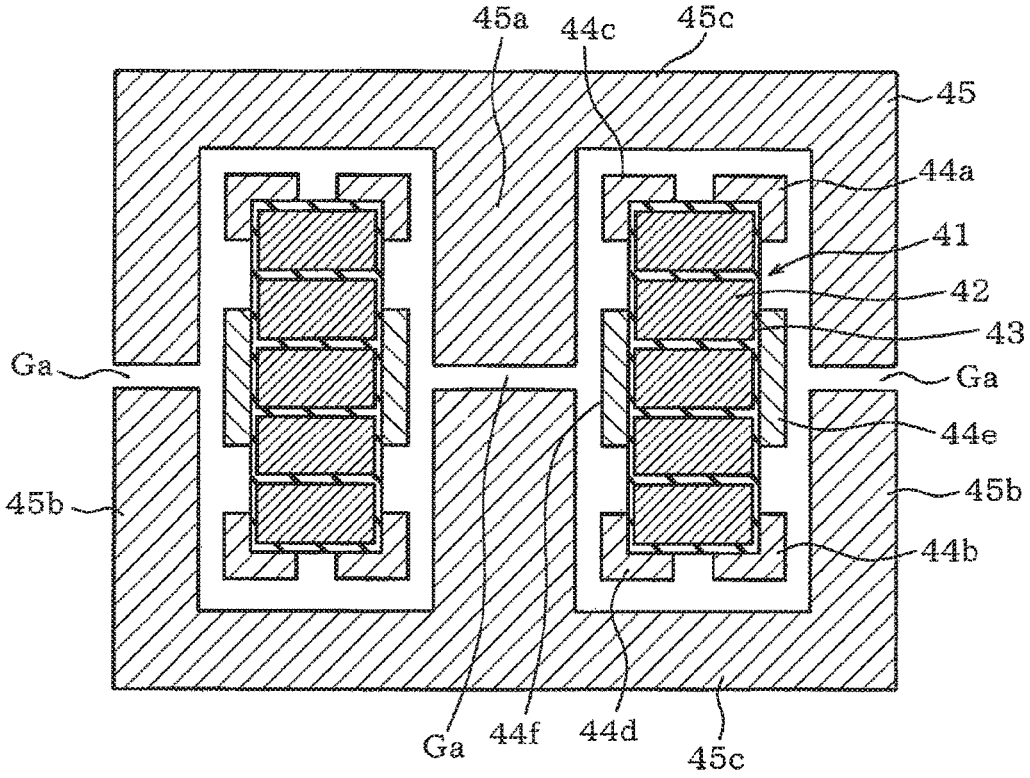
FIG. 9 is a longitudinal sectional view of a coil according to a fifth embodiment.

FIG. 9 illustrates a fifth embodiment and the parts different from the fourth embodiment are explained. The embodiment is configured to have a coil 41 in place of the coil 31 illustrated in the fourth embodiment and an iron core 45 in place of the iron core 35.

In the embodiment, as illustrated in FIG. 9, a coil 41 is configured to have a magnetic material section 44 (44*a* to 44*f*) split into 6 sections so as to expose parts of the surface of an insulation film 43 over a wound conductor 42 and arranged. The coil 41 is attached to an iron core 45 having gaps Ga. In the iron core 45, a leg section 45*a* passing through the center of the coil 41 and two leg sections 45*b* located outside the coil 41 are connected to yokes 45*c* arranged at the top and bottom. The leg sections 45*a* and 45*b* are configured to have the gaps Ga in the center of the z direction. In the iron core 45, a magnetic resistance increases at the gaps Ga, a magnetic flux spreads outside, and leakage is generated. The magnetic material sections 44*e* and 44*f* attached to the coil 41 are arranged in the manner of corresponding to the gaps Ga of the iron core 45.

In the coil 41 over which the iron core 45 of such a configuration is installed, the magnetic flux in the iron core 45 leaks at the gaps Ga and comes to be a component acting on the coil 41. The magnetic flux leaking at the gaps Ga however flows just in the magnetic material sections 44*e* and 44*f* of the coil 41 and the direct action to the coil 41 can be restrained. As a result, eddy-current loss can be restrained from increasing similarly to the fourth embodiment.

Sixth Embodiment

Figure 10:
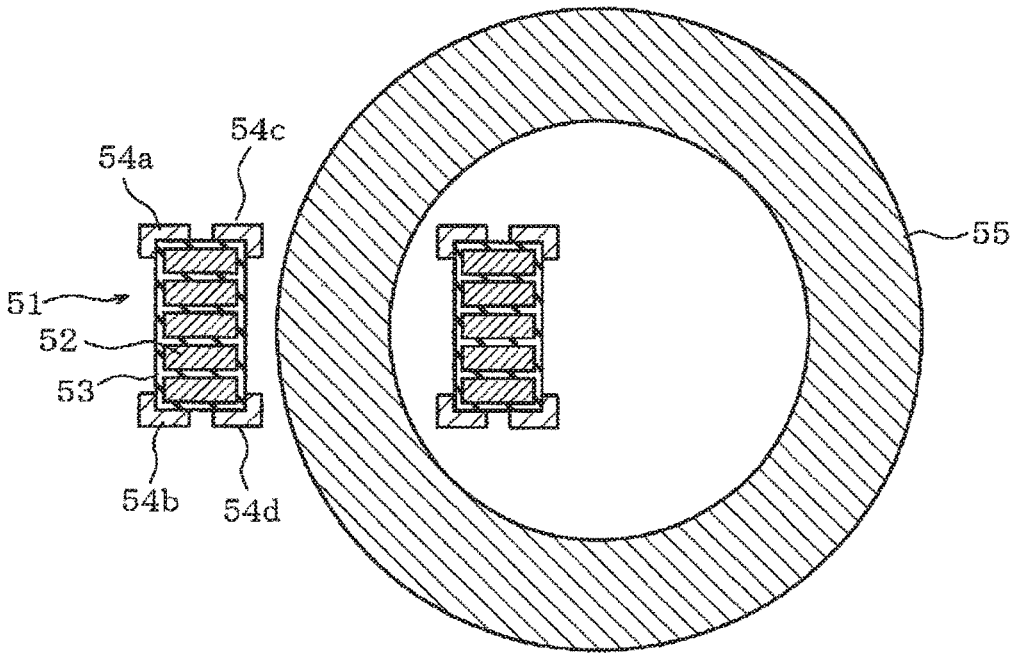
FIG. 10 is a longitudinal sectional view of a coil according to a sixth embodiment.
Figure 11:
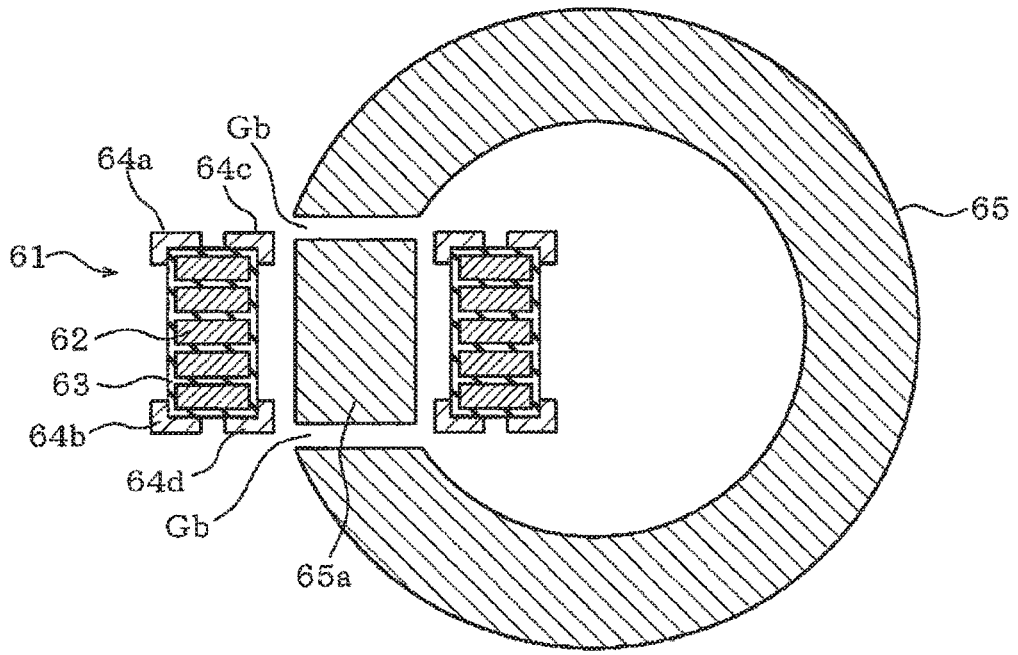
FIG. 11 is a longitudinal sectional view of another coil according to the sixth embodiment.

FIGS. 10 and 11 illustrate a sixth embodiment. In the embodiment, a toroidal core of an annular shape is used as an iron core.

As illustrated in FIG. 10, a coil 51 is formed by winding a conductor 52 covered with an insulation film 53 similarly to the coil 21 illustrated in the third embodiment. A magnetic material section 54*a* covering upper outside-and-top faces, a magnetic material section 54*b* covering lower outside-and-bottom faces, a magnetic material section 54*c* covering upper inside-and-top faces, and a magnetic material section 54*d* covering lower inside-and-bottom faces, those faces constituting the surface of the coil 51, are installed respectively. The magnetic material sections 54*a* to 54*d* are formed by attaching tabular magnetic materials comprising a soft magnetic material to the coil 51 respectively. The thicknesses of the magnetic material sections 54*a* to 54*d* are in the range of 0.1 to 3.0 mm for example.

The coil 51 of such a configuration is attached to an annular toroidal core 55. In the embodiment, the coil 51 is installed so as to be inserted into an annular part of the toroidal core 55. More specifically, the coil 51 is formed by inserting and winding the conductor 52 into and around the toroidal core 55.

According to the configuration, since, in the coil 51, the magnetic material sections 54*a* to 54*d* covering the four corners on the outer and inner circumferences of the coil 51 where a magnetic flux density rises are arranged so as to have large cross-sectional areas at the corners in the parts through which a magnetic flux generated when an electric current is applied passes, the increase and saturation of the magnetic flux density can be restrained and the generation of eddy current can be further reduced accordingly.

Further, since the magnetic material sections 54*a* to 54*d* are formed separately at the four corners of the coil 51 and gaps where a magnetic material is not arranged are formed at the outer and inner circumference surface parts and the top and bottom surface parts in the z-axis direction, a magnetic resistance can be increased sufficiently, the magnetic flux densities at the magnetic material sections 54*a* to 54*d* further lower accordingly, the magnetic so saturation of the magnetic material sections 54*a* to 54*d* is further mitigated, and eddy-current loss at the part covered with the magnetic material can be restrained appropriately from being generated. As a result, the alternating-current resistance of the coil 51 can be reduced.

FIG. 11 illustrates a configuration of attaching a coil 61 to a toroidal core 65 having gaps in place of the toroidal core 55 in the above configuration. The coil 61 is formed by winding a conductor 62 covered with an insulation film 63 similarly to the coil 51 stated above. A magnetic material section 64*a* covering upper outside-and-top faces, a magnetic material section 64*b* covering lower outside-and-bottom faces, a magnetic material section 64*c* covering upper inside-and-top faces, and a magnetic material section 64*d* covering lower inside-and-bottom faces, those faces constituting the surface of the coil 61, are installed respectively. The magnetic material sections 64*a* to 64*d* are formed by attaching tabular magnetic materials comprising a soft magnetic material to the coil 61 respectively. The thicknesses of the magnetic material sections 64*a* to 64*d* are in the range of 0.1 to 3.0 mm for example.

The coil 61 of such a configuration is attached to an annular toroidal core 65 having gaps Gb. In the embodiment, parts of the annular toroidal core 65 are removed and the toroidal core 65 has a C-shape as a whole. An iron core 65*a* is inserted into the center of the coil 61. The coil 65 is installed in the gap of the toroidal core 65. In the state of attaching the coil 65, the state of forming the gaps Gb between the coil 61 and the toroidal core 65 is obtained.

According to the above configuration, in addition to the effect of the configuration of using the toroidal core 55 having no gaps illustrated in FIG. 10, by using the toroidal core 65 having the gaps Gb, although the magnetic flux in the toroidal core 65 leaks at the gaps Gb and constitutes a component acting on the coil 61, the magnetic flux leaking at the gaps Gb flows just in the magnetic material sections 64*a* to 64*d* in the coil 61 and can be restrained from acting directly on the coil 61. As a result, eddy-current loss can be restrained from increasing.

Seventh Embodiment

Figure 12A:
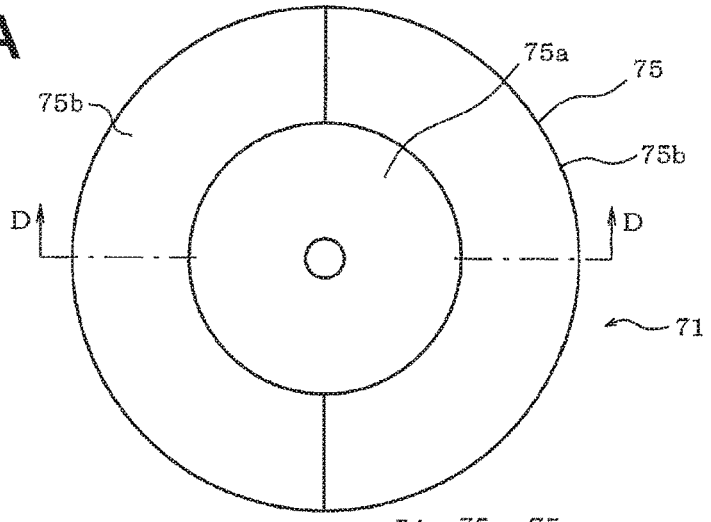
FIG. 12A is a top view of a coil.
Figure 12B:
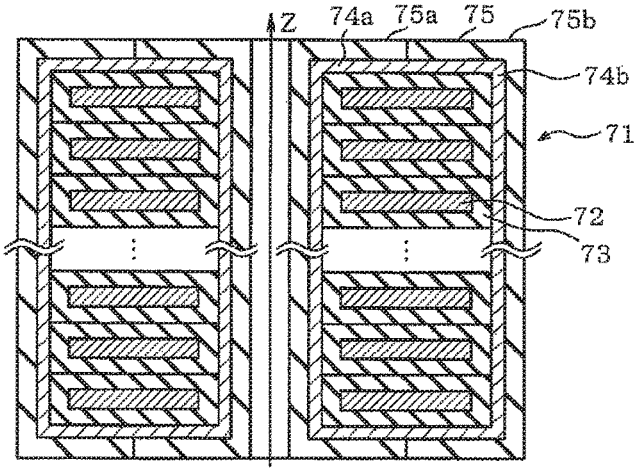
FIG. 12B is a longitudinal sectional view of the coil taken on line D-D in FIG. 12A.
Figure 12C:
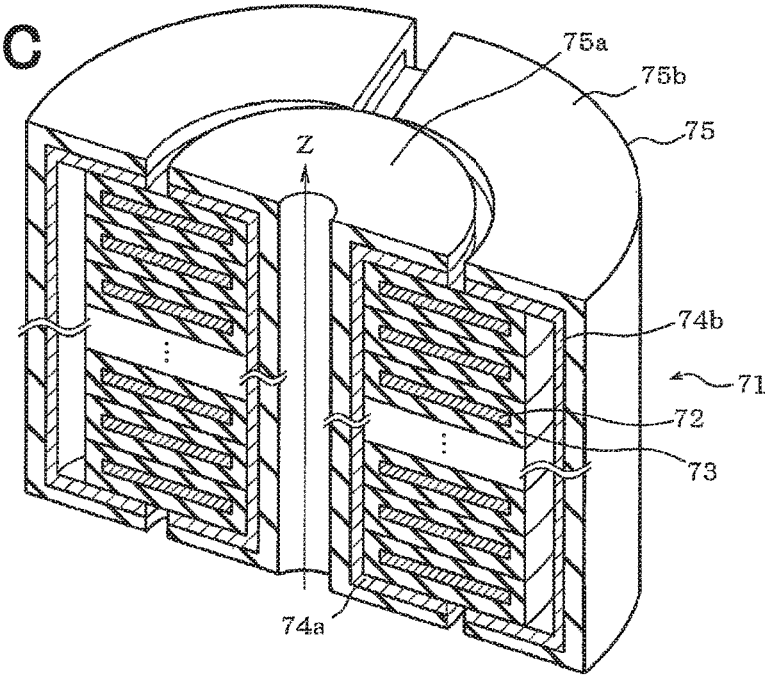
FIG. 12C is an external perspective view illustrating a longitudinal sectional side face of the coil according to a seventh embodiment.

FIGS. 12A to 12C illustrate a seventh embodiment. The parts different from the first embodiment are explained hereunder. A coil 71 is formed by winding a rectangular conductor 72 and the surface of the conductor 72 is covered with an insulation film 73. Magnetic materials 74*a* and 74*b* are arranged as a magnetic material section 74 comprising a soft magnetic material over a top face, a bottom face, an outside face, and an inside face, those faces constituting the surface of the coil 71. The magnetic materials 74*a* and 74*b* are attached to a coil bobbin 75.

The coil bobbin 75 is made of an insulator such as a resin and comprises a bobbin 75*a* and two bobbin cases 75*b*. The bobbin 75*a* comprises an axis section and top and bottom flange sections and has a shape of a bobbin and the magnetic material section 74*a* is attached with an adhesive or the like in the manner of covering the surface of the axis section and the inside faces of the flange sections. The conductor 72 is wound around the z-axis of the axis section in the bobbin 75*a*.

The bobbin case 75*b* has a shape formed by splitting a cylinder having a top face and a bottom face into haft in the axis direction and a magnetic material section 74*b* is attached with an adhesive or the like in the manner of covering the backside of the top face, the backside of the bottom face, and the inside of the cylinder face. The bobbin case 75*b* is attached to the bobbin 75*a* in the manner of covering the conductor 72 exposed outside the bobbin 75*a*.

In the state of attaching the coil bobbin 75, the whole surface of the coil 71 is in the state of being covered with the magnetic material sections 74*a* and 74*b*. The thicknesses of the magnetic material sections 74*a* and 74*b* are as a whole identical and in the range of 0.1 to 3.0 mm for example.

The coil 71 of the above configuration is used as a transformer or a reactor in the state of being attached to an iron core (core) not illustrated in the figures. As the iron core, an E-type or an I-type is used for example. In the case of an E-type iron core, the iron core penetrates and is inserted into the part of the axis z in the winding center of the coil 1 and is installed also on the outer circumference side of the coil 71 in the manner of surrounding the coil 71. In the case of an I-type iron core, the iron core is installed in the state of penetrating at the part of the axis z in the winding center of the coil 71. Here, since the coil 1 is attached to the coil bobbin 75, the outer peripheral face is in the state of having an insulator and the coil 71 can be attached directly to the iron core.

As a result of the above configuration, the same functional effects as the first embodiment can be obtained. Further, since the magnetic material section 74 is attached to the coil bobbin 75, the magnetic material section 74 can be arranged easily by attaching the coil bobbin 75 to the wound conductor 72.

Here, although the coil bobbin 75 is configured to be split into the bobbin 75*a* and two bobbin cases 75*b* in the embodiment, the method of splitting the coil bobbin 75 may be variously modified by increasing a split number or changing a split part. For example, the bobbin 75*a* may not be monolithic but be split in the middle of the z-axis direction. Further, in the bobbin 75*a*, one of the flanges may be installed integrally on the side of the bobbin case 75*b* or a flange may be installed as another piece. Here, by splitting the bobbin 75*a* in this way, the conductor 72 can be wound beforehand and can be attached to the bobbin 75*a*.

Eighth Embodiment

Figure 13A:
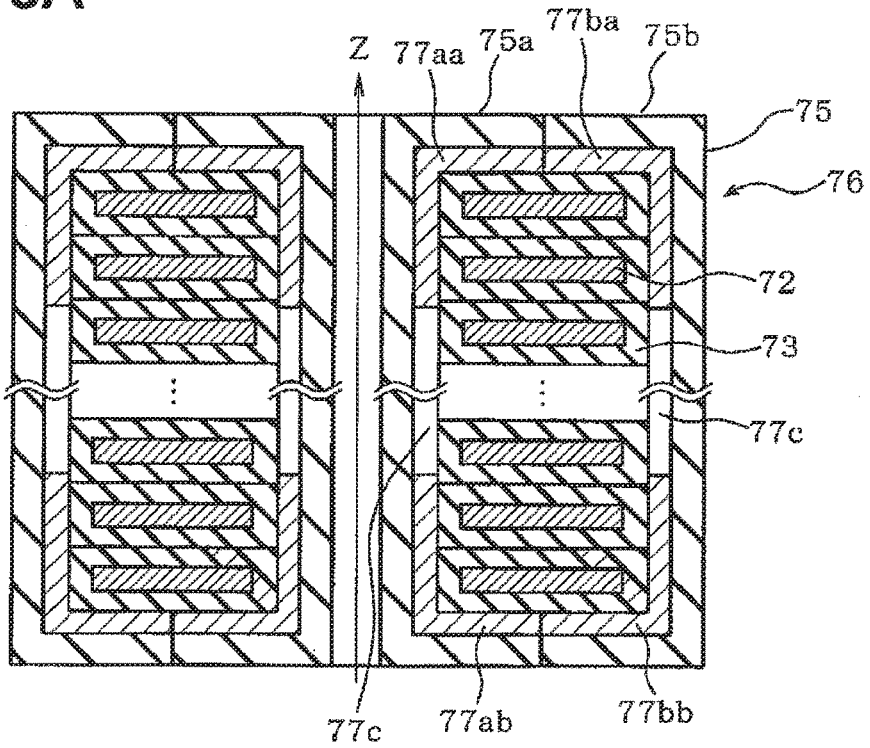
FIG. 13A is a longitudinal sectional view of a coil.
Figure 13B:
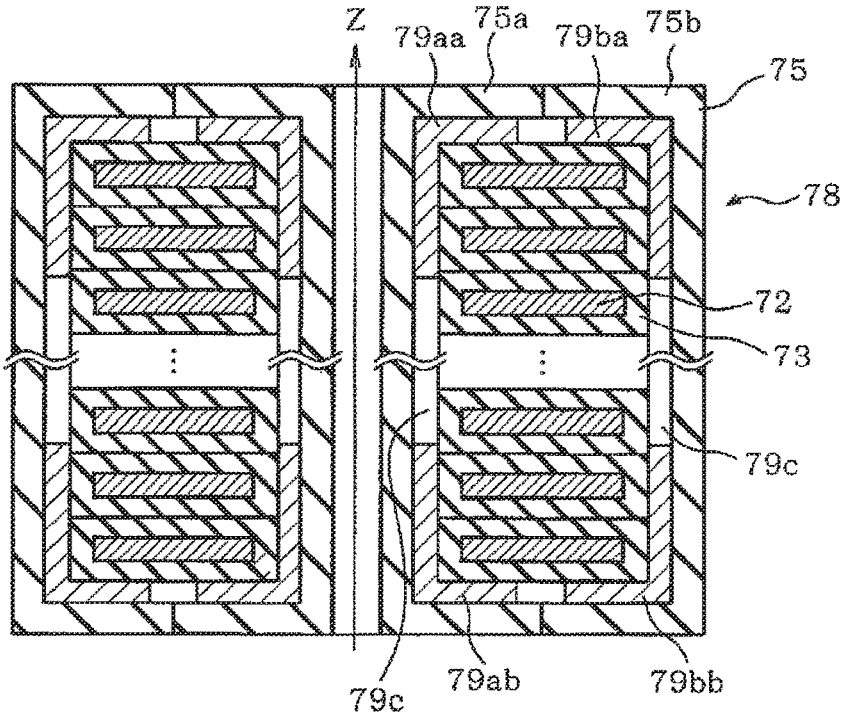
FIG. 13B is a longitudinal sectional view of another coil according to an eighth embodiment.

FIGS. 13A and 13B illustrate an eighth embodiment. The parts different from the seventh embodiment are explained hereunder. FIG. 13A illustrates a coil 76 configured to arrange a magnetic material section 74 attached to the coil bobbin 75 in the configuration of the coil 71 equally to the second embodiment. More specifically, a magnetic material section 77*a* attached to a bobbin 75*a* is split into 77*aa* and 77*ab* one above the other and a magnetic material section 77*b* attached to a bobbin case 75*b* is split into 77*ba* and 77*bb* one above the other. As a result, the magnetic material sections 77*a* and 77*b* are in the state where intermediate sections in the z-axis direction are partially cut, namely in the state of having gaps. Here, the gaps where no magnetic material section is installed may retain a space or may be provided with an insulator.

As a result, the magnetic material sections 77*aa*, 77*ab*, 77*ba*, and 77*bb* are installed at the parts corresponding to the start and end of the winding of a conductor 72 respectively in the coil 76. The magnetic material sections 77*aa*, 77*ab*, 77*ba*, and 77*bb* are tabular magnetic materials comprising a soft magnetic material respectively and the thicknesses are in the range of 0.1 to 3.0 mm for example.

Since the coil 76 is configured as described above, effects similar to the seventh embodiment can be obtained and also functional effects similar to the second embodiment can be obtained. Successively, FIG. 13B illustrates a coil 78 configured to arrange the magnetic material section 74 attached to the coil bobbin 75 in the configuration of the coil 71 equally to the second embodiment. More specifically, a magnetic material section 79*a* attached to a bobbin 75*a* is split into 79*aa* and 79*ab* one above the other and a magnetic material section 79*b* attached to a bobbin case 75*b* is split into 79*ba* and 79*bb* one above the other.

In the embodiment further, the distance between the planes facing each other of the magnetic material section 79*aa* and the magnetic material section 79*ba* and the distance between the planes facing each other of the magnetic material section 79*ab* and the magnetic material section 79*bb* are configured so as to be larger than the distance between the planes facing each other of the bobbin 75*a* and the bobbin case 75*b* in order to form gaps between them. As a result, the magnetic material sections 79*a* and 79*b*: are in the state where intermediate sections in the z-axis direction are partially cut, namely in the state of having gaps; and are in the state where intermediate sections of the top face and the bottom face are partially cut. Here, the gaps where no magnetic material section is installed may retain a space or may be provided with an insulator.

As a result, the magnetic material sections 79*aa*, 79*ab*, 79*ba*, and 79*bb* are installed at the corners of the parts corresponding to the start and end of the winding of a conductor 72 respectively in the coil 78. The magnetic material sections 79*aa*, 79*ab*, 79*ba*, and 79*bb* are tabular magnetic materials comprising a soft magnetic material respectively and the thicknesses are in the range of 0.1 to 3.0 mm for example.

Since the coil 76 is configured as described above, effects similar to the seventh embodiment can be obtained and also functional effects similar to the third embodiment can be obtained. In the coils 76 and 78, the magnetic material sections 77*aa*, 77*ab*, 77*ba*, and 77*bb* and the magnetic material sections 79*aa*, 79*ab*, 79*ba*, and 79*bb* can be arranged by setting the thicknesses appropriately. Since gaps are formed in particular, by arranging a magnetic material to be arranged in the gaps at the magnetic material sections, the magnetic material can be used efficiently.

Ninth Embodiment

Figure 14A:
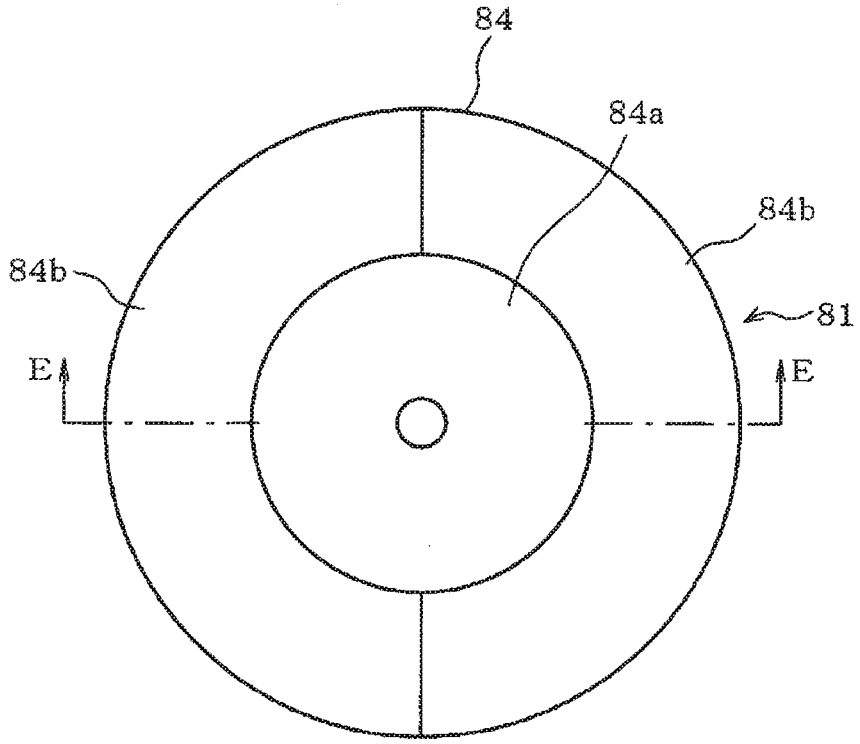
FIG. 14A is a top view of a coil.
Figure 14B:
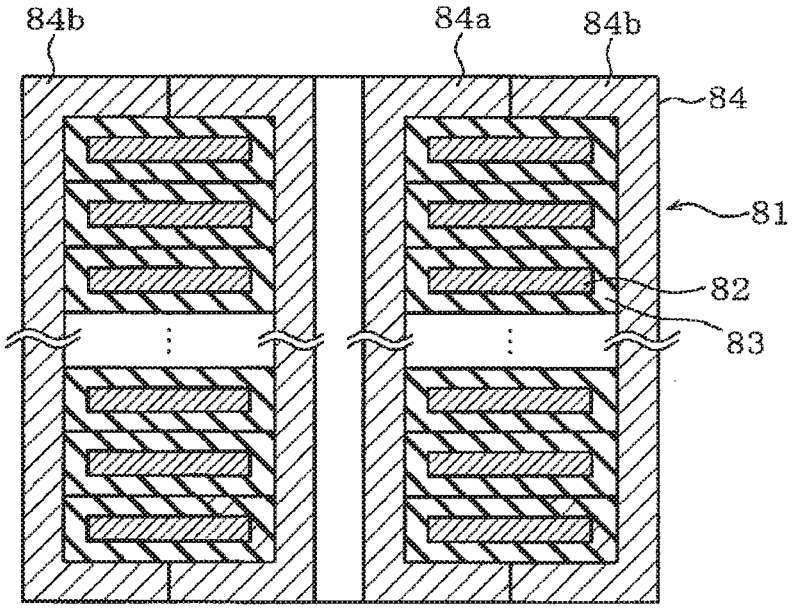
FIG. 14B is a longitudinal sectional view of the coil taken on line E-E in FIG. 14A according to a ninth embodiment.

FIGS. 14A to 15B illustrate a ninth embodiment. The parts different from the seventh and eighth embodiments are explained hereunder. FIGS. 14A and 14B illustrate a coil 81. The coil 81 has a coil bobbin 84 in place of the coil bobbin 75 of the coil 76 explained in the seventh embodiment.

The coil 81 is formed by winding a rectangular conductor 82 and the surface of the conductor 82 is covered with an insulation film 83. The coil bobbin 84 is configured by integrally forming a material obtained by mixing a soft magnetic material with a resin or the like so as to function as a magnetic material section. The coil bobbin 84 comprises a bobbin 84*a* and two bobbin cases 84*b*. The coil 81 is formed by winding the conductor 82 around the bobbin 84*a* and successively attaching the two bobbin cases 84*b*. As a result, by adopting the coil bobbin 84, the coil 81 has a soft magnetic material as the magnetic material section constituting the coil bobbin 84 over a top face, a bottom face, an outside face, and an inside face, those faces constituting the surface.

The coil 81 of the above configuration is used as a transformer or a reactor in the state of being attached to an iron core (core) not illustrated in the figures. As the iron core, an E-type or an I-type is used for example. Here, since the core 81 is configured so that the coil bobbin 84 may be used also as the magnetic material section, when the coil 81 is attached to an iron core, the coil 81 is arranged in the state of covering the outer peripheral face with an insulator or the like or in the state of forming a gap between the coil 81 and the iron core.

As a result of the above configuration, the same functional effects as the seventh embodiment can be obtained. Further, since the coil bobbin 84 comprises a material including a magnetic material so as to be used commonly as the magnetic material section, the number of assembly parts can be reduced.

Figure 15A:
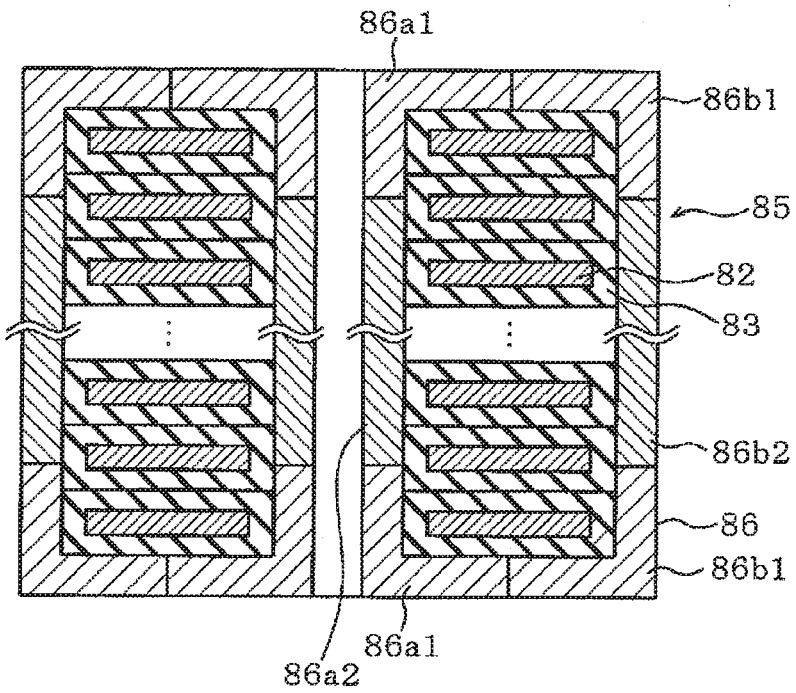
FIG. 15A is a longitudinal sectional view of a coil.
Figure 15B:
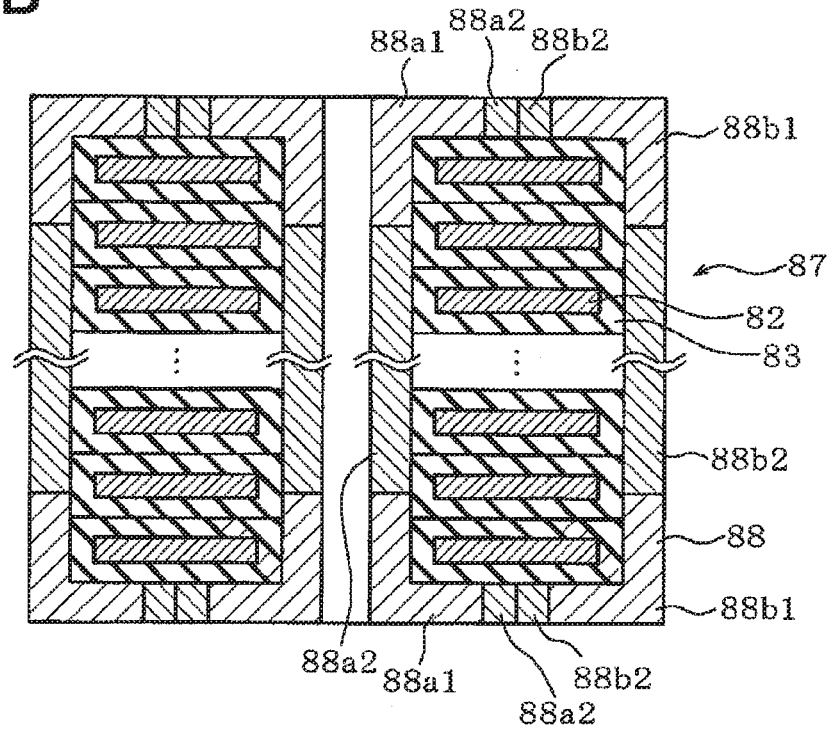
FIG. 15B is a longitudinal sectional view of another coil according to the ninth embodiment.

Further, FIGS. 15A and 15B illustrate the cases of using coils 85 and 87 of the types of the second and third embodiments in place of the coil 81 of the above configuration for the same purposes, FIG. 15A illustrates a coil 85. The coil 85 is formed by winding a rectangular conductor 82 similar to the coil 81 and the surface of the conductor 82 is covered with an insulation film 83. A coil bobbin 86 is configured by integrally shaping a material obtained by mixing a soft magnetic material with a resin or the like so as to function as a magnetic material section. The coil bobbin 86 comprises a bobbin 86*a* and two bobbin cases 86*b*. In this instance, a different soft magnetic material is used partially as the coil bobbin 86.

More specifically, with regard to the bobbin 86*a* and the bobbin cases 86*b* of the coil bobbin 86, the bobbin 86*a* comprises a first magnetic material section 86*a*1 and a second magnetic material section 86*a*2 and the bobbin cases 86*b* comprise a first magnetic material section 86*b*1 and a second magnetic material section 86*b*2. The first magnetic material sections 86*a*1 and 86*b*1 are installed in accordance with the parts including corners of the coil 85 and are formed with a resin with which a soft magnetic material of a first magnetic material having a first magnetic permeability is mixed. The second magnetic material sections 86*a*2 and 86*b*2 are installed at parts corresponding to the intermediate section of the coil 85 in the z-axis direction and a soft magnetic material having a magnetic permeability smaller than the first magnetic permeability is mixed in a resin as a second magnetic material having a second magnetic permeability. The coil 85 is formed by winding the conductor 82 around the bobbin 86*a* and successively attaching the two bobbin cases 86*b*.

The coil 85 of the above configuration is used as a transformer or a reactor in the state of being attached to an iron core (core) not illustrated in the figures. As the iron core, an E-type or an I-type is used for example. Here, since the core 85 is configured so that the bobbin 86 may be used also as the magnetic material section, when the coil 85 is attached to an iron core, the coil 85 is arranged in the state of covering the outer peripheral face with an insulator or the like or in the state of forming a gap between the coil 85 and the iron core.

As a result of the above configuration, functional effects similar to the eighth embodiment can be obtained. Further, functional effects similar to the second embodiment can also be obtained. Successively, FIG. 15B illustrates a coil 87. The coil 87 is formed by winding a rectangular conductor 82 similarly to the coil 81 and the surface of the conductor 82 is covered with an insulation film 83. A coil bobbin 88 is configured by integrally shaping a material obtained by mixing a soft magnetic material with a resin or the like so as to function as a magnetic material section. The coil bobbin 88 comprises a bobbin 88*a* and two bobbin cases 88*b*. In this instance, a different soft magnetic material is used partially as the coil bobbin 88 similarly to the coil bobbin 86.

More specifically, with regard to the bobbin 88*a* and the bobbin cases 88*b* of the coil bobbin 88, the bobbin 88*a* comprises a first magnetic material section 88*a*1 and a second magnetic material section 88*a*2 and the bobbin cases 88*b* comprise a first magnetic material section 88*b*1 and a second magnetic material section 88*b*2. The first magnetic material sections 88*a*1 and 88*b*1 are installed in accordance with the parts including corners of the coil 85 and are formed with a resin with which a soft magnetic material of a first magnetic material having a first magnetic permeability is mixed. The second magnetic material sections 88*a*2 and 88*b*2 are installed at parts corresponding to the intermediate section of the coil 87 in the z-axis direction and at intermediate sections of the top and bottom faces of the coil 87 and a soft magnetic material having a magnetic permeability smaller than the first magnetic permeability is mixed in a resin as a second magnetic material having a second magnetic permeability. The coil 87 is formed by winding the conductor 82 around the bobbin 88*a* and successively attaching the two bobbin cases 88*b*.

In the above configuration, as the first magnetic material of the first magnetic permeability constituting the first magnetic material sections 88*a*1 and 88*b*1, ferrite or iron (Fe) alloy can be used for example. Further, as the second magnetic material of the second magnetic permeability constituting the second magnetic material sections 88*a*2 and 88*b*2, iron alloy or iron (Fe) amorphous, each having a magnetic permeability smaller than ferrite, can be used for example. Otherwise, as the second magnetic material, a resin or the like having a magnetic permeability smaller than the iron alloy or iron amorphous can also be used. Here, the first magnetic permeability may be not less than five times the second magnetic permeability.

As a result of the above configuration, functional effects similar to the eighth embodiment can be obtained. Further, functional effects similar to the third embodiment can also be obtained. Here, although each of the coil bobbins 86 and 88 comprises the first magnetic material section and the second magnetic material section in the above configuration, it is also possible to directly install a resin in the state of excluding a magnetic material other than a magnetic material in place of the second magnetic material section. Further, a resin section configured to have a space in the interior may also be installed.

Tenth Embodiment

Figure 16A:
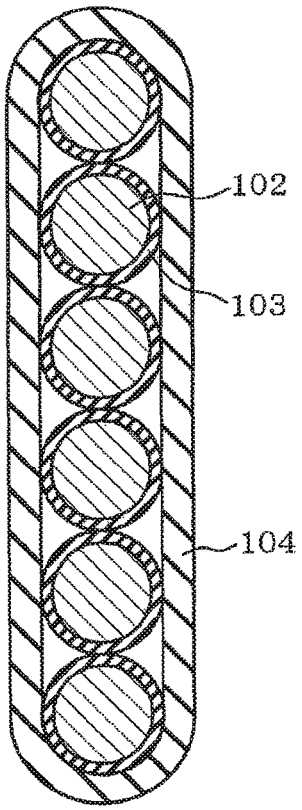
FIG. 16A is a longitudinal sectional view of a coil.
Figure 16B:
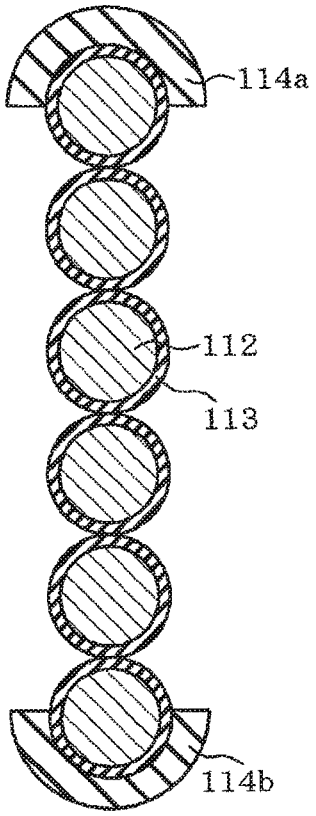
FIG. 16B is a longitudinal sectional view of another coil.
Figure 16C:
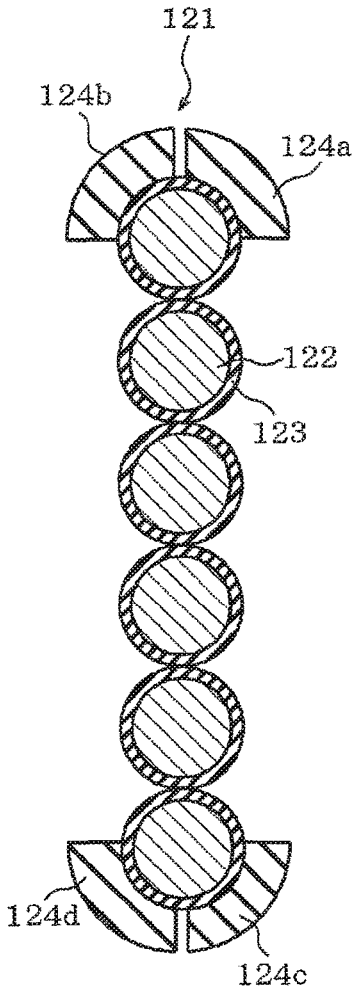
FIG. 16C is a longitudinal sectional view of still another coil according to a tenth embodiment.

FIGS. 16A to 16C illustrate a tenth embodiment. FIGS. 16A, 16B, and 16C illustrate partial cross sections of coils 101, 111, and 121 respectively. Conductors 102, 112, and 122 of the coils 101, 111 and 121 have cross sections of a round shape and the outer peripheral faces are covered with insulation films 103, 113, and 123 respectively. In the coils 101, 111, and 121, magnetic material sections 104, 114*a*, 114*b*, and 124*a* to 124*d* are installed so as to cover the parts corresponding to coil corners to the same effects as described in the first, second, and third embodiments.

As a result of the above configuration, functional effects similar to the first to third embodiments can be obtained also in the coils 101, 111, and 121 using the conductors 102, 112, and 122 having round cross sections.

Here, the present disclosure is not limited to the aforementioned embodiments and is applicable to various embodiments in the range not departing from the tenor. For example, the following modification or expansion may be applied.

The thickness of a magnetic material section can arbitrarily be set in accordance with a used frequency or a specification of a magnetic circuit component. Further, although the case of arranging a magnetic material section by attaching a tabular one is described, the magnetic material section may be formed by plating or the like or may be formed as a three-dimensional object like a coil bobbin by shaping or the like. Furthermore, although a magnetic material section is installed by being attached to the outer peripheral face of a coil, the magnetic material section may be formed into a case shape and installed so as to surround a coil outer peripheral face other than being arranged in a tight state.

Like in the second to sixth embodiments or the eighth embodiment, when a magnetic material section is split and arranged over a coil surface, a gap section not containing a magnetic material is a space. In contrast, the gap section is not a space and the configuration of arranging a magnetic material having a smaller magnetic permeability than a magnetic material constituting a magnetic material section or arranging an insulator can be adopted like the configuration described in the ninth embodiment.

While the present disclosure has been described with reference to embodiments thereof, it is to be understood that the disclosure is not limited to the embodiments and constructions. The present disclosure is intended to cover various modification and equivalent arrangements. In addition, the various combinations and configurations, other combinations and configurations, including more, less or only a single element, are also within the spirit and scope of the present disclosure.

The invention claimed is:

1. A magnetic circuit component comprising:

a magnetic core that includes a leg section that extends in a z-direction;

a coil that is formed by winding a conductor in the z-direction around the leg section of the magnetic core, the coil includes at least a corner or a bent portion of an end part of the coil on a cross section obtained by cutting the coil in an axial direction along the z-direction;

a magnetic material section that is formed from a soft magnetic material and that covers, and is in direct contact with, a part of a surface of the coil or an entire surface of the coil and is spaced apart from the magnetic core, wherein the magnetic material section that covers, and is in direct contact with, the part of the surface or the entire surface of the coil is located between the magnetic core and the coil, and the magnetic material section covers, and is in direct contact with, at least the corner part of the coil or the bent portion of the end part of the coil on the cross section obtained by cutting the coil in the axial direction.

2. The magnetic circuit component according to claim 1, wherein the magnetic material section covers at least corner parts of the coil or end bent portions of the coil on the cross section obtained by cutting the coil in its axial direction, and has at least a split part between the adjacent corner parts or between the adjacent end bent portions.

3. The magnetic circuit component according to claim 1, wherein:

a first magnetic material section having a first magnetic permeability is disposed for a part of the magnetic material section that covers at least the corner part of the coil or the bent portion of the end part of the coil on the cross section obtained by cutting the coil in its axial direction; and a second magnetic material section having a second magnetic permeability that is lower than the first magnetic permeability is disposed for the other part of the magnetic material section.

4. The magnetic circuit component according to claim 3, wherein a soft magnetic material is used for the second magnetic material section.

5. The magnetic circuit component according to claim 3, wherein an insulator is used for the second magnetic material section.

6. The magnetic circuit component according to claim 1, wherein:

a first magnetic material section having a first magnetic permeability is disposed for a part of the magnetic material section that covers at least corner parts of the coil or end bent portions of the coil on the cross section obtained by cutting the coil in its axial direction; and a second magnetic material section having a second magnetic permeability that is lower than the first magnetic permeability is disposed between the adjacent corner parts or between the adjacent end bent portions.

7. The magnetic circuit component according to claim 6, wherein a soft magnetic material is used for the second magnetic material section.

8. The magnetic circuit component according to claim 6, wherein an insulator is used for the second magnetic material section.

9. The magnetic circuit component according to claim 1, wherein:

the magnetic core includes a gap portion at a part of a magnetic circuit, the gap portion having a larger magnetic resistance than at the other part of the magnetic circuit; and the magnetic material section is disposed to cover the coil also at its part corresponding to the gap portion.

10. The magnetic circuit component according to claim 1, wherein the magnetic core is a toroidal core.

11. The magnetic circuit component according to claim 10, further comprising a coil bobbin that fixes the coil, wherein the magnetic material section is disposed integrally with the coil bobbin.

12. The magnetic circuit component according to claim 11, wherein the magnetic material section is the coil bobbin formed from a soft magnetic material.

13. The magnetic circuit component according to claim 1, wherein the magnetic material section that covers the part of the surface of the coil or the entire surface of the coil is disposed entirely away from the magnetic core.

14. The magnetic circuit component according to claim 1, wherein the magnetic material section is spaced apart from the magnetic core by a gap that does not contain a magnetic material.

* * * * *